US006885366B1

(12) United States Patent
Tanaka

(10) Patent No.: US 6,885,366 B1
(45) Date of Patent: Apr. 26, 2005

(54) DISPLAY DEVICE

(75) Inventor: Yukio Tanaka, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 49 days.

(21) Appl. No.: 09/672,738

(22) Filed: Sep. 28, 2000

(30) Foreign Application Priority Data

Sep. 30, 1999 (JP) ..... 11-280605

(51) Int. Cl.[7] ..... G09G 5/00

(52) U.S. Cl. ..... 345/204; 345/92; 345/99; 345/100

(58) Field of Search ..... 34/92, 87, 99, 34/100, 103, 204; 345/92, 87, 99, 100, 103

(56) References Cited

U.S. PATENT DOCUMENTS 4,830,466 A * 5/1989 Matsuhashi et al. ..... 349/143
5,481,121 A 1/1996 Zhang et al. ..... 257/64
5,495,353 A 2/1996 Yamazaki et al. ..... 359/54
5,568,163 A * 10/1996 Okumura ..... 345/100

(Continued)

FOREIGN PATENT DOCUMENTS

JP 7-130652 5/1995

OTHER PUBLICATIONS

Inui, S. et al, "Thresholdless Antiferroelectricity in Liquid Crystals and its Application to Displays," *J. Mater. Chem.*, vol. 6, No. 4, pp. 671–673, 1996.

Yoshida, T. et al, "A Full–Color Thresholdless Antiferroelectric LCD Exhibiting Wide Viewing Angle with Fast Response Time," *SID 97 Digest,* pp. 841–844, 1997.

Furue, H. et al, "Characteristics and Driving Scheme of Polymer–Stabilized Monostable FLCD Exhibiting Fast Response Time and High Contrast Ratio with Gray–Scale Capability," *SID 98 Digest,* pp. 782–785, 1998.

Terada, M. et al, "Half–V Switching Mode FLCD," *Proceedings of the 46th Applied Physics Association Lectures,* Society for Applied Physics of Japan, 28p–V–8, p. 1316, Mar., 1999.

Yoshihara, T. et al, "Time Division Full Color LCD by Ferroelectric Liquid Crystal," *EKISHO,* vol. 3, No. 3, pp. 190–194, 1999.

English abstract re Japanese patent application No. 7–130652, published May 19, 1995.

*Primary Examiner*—Albert Decady
*Assistant Examiner*—Fritz Alphonse
(74) *Attorney, Agent, or Firm*—Cook, Alex, McFarron, Manzo, Cummings & Mehler, Ltd.

(57) ABSTRACT

A device such as a liquid crystal display is provide, in which every pixel can sufficiently realize writing of a video signal into a storage capacitor. The liquid crystal display device of the present invention includes left and right gate drivers. The left gate driver is connected to supply selection signals to TFTs of pixels of a left half of a pixel portion. The right gate driver is connected to supply selection signals to TFTs of pixels of a right half of the pixel portion. In the liquid crystal display device of the present invention, timing when the left gate driver outputs a selection signal to a gate signal line connected to a pixel of a column is different from timing when the right gate driver outputs a selection signal to a gate signal line connected to a pixel of the same row as the pixel.

25 Claims, 19 Drawing Sheets

U.S. PATENT DOCUMENTS 5,594,569 A 1/1997 Konuma et al. ..... 349/122
5,623,157 A 4/1997 Miyazaki et al. ..... 257/383
5,643,826 A 7/1997 Ohtani et al. ..... 437/88
5,712,495 A 1/1998 Suzawa ..... 257/51
5,745,093 A * 4/1998 Tsuzuki et al. ..... 345/103
5,825,342 A * 10/1998 Akebi et al. ..... 345/87
5,923,962 A 7/1999 Ohtani et al. ..... 438/150
5,939,731 A 8/1999 Yamazaki et al. ..... 257/59
6,011,607 A 1/2000 Yamazaki et al. ..... 349/153
6,037,923 A * 3/2000 Suzuki ..... 345/92
6,163,310 A * 12/2000 Jinno et al. ..... 345/87
6,225,967 B1 * 5/2001 Hebiguchi ..... 345/88
6,243,064 B1 * 6/2001 Hirakata ..... 345/96
6,345,894 B1 * 2/2002 Mori ..... 353/31
6,384,886 B1 * 5/2002 Yamazaki et al. ..... 349/113
6,433,361 B1 8/2002 Zhang et al. ..... 257/59
6,437,767 B1 * 8/2002 Cairns et al. ..... 345/100

* cited by examiner

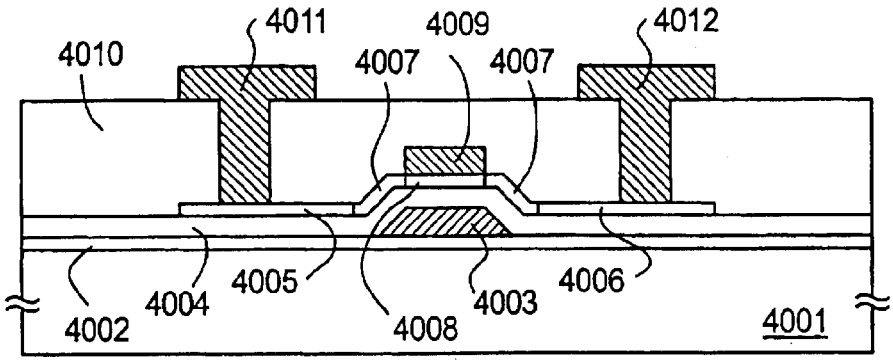

4001 SUBSTRATE
4002 SILICON OXIDE FILM
4003 GATE ELECTRODE
4004 GATE INSULATING FILM
4005 SOURCE REGION
4006 DRAIN REGION
4007 LOW CONCENTRATION IMPURITY REGION(LDD REGION)
4008 CHANNEL FORMING REGION
4009 CHANNEL PROTECTING FILM
4010 INTERLAYER INSULATING FILM
4011 SOURCE ELECTRODE
4012 DRAIN ELECTRODE

FIG. 13A

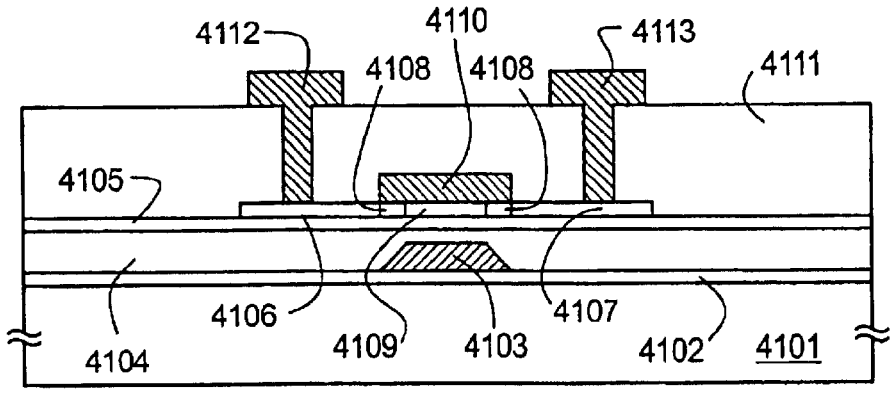

4101 SUBSTRATE
4102 SILICON OXIDE FILM
4103 GATE ELECTRODE
4104 BENZOCYCLOBUTENE(BCB)
4105 SILICON NITRIDE FILM
4106 SOURCE REGION
4107 DRAIN REGION
4108 LOW CONCENTRATION IMPURITY REGION(LDD REGION)
4109 CHANNEL FORMING REGION
4110 CHANNEL PROTECTING FILM
4111 INTERLAYER INSULATING FILM
4112 SOURCE ELECTRODE
4113 DRAIN ELECTRODE

FIG. 13B

DISPLAY DEVICE

BACKGROUND OF THE INVENTION

1. Field of the Invention

The present invention relates to a display device. Specifically, the invention relates to a display device using an active matrix type display device such as liquid crystal display device.

2. Description of the Related Art

Rapid development has been made in recent years in a technique for manufacturing a semiconductor device, for example, a thin film transistor (TFT), which has a semiconductor thin film formed on an inexpensive glass substrate. This is because there is an increasing demand for active matrix type liquid crystal display devices (hereinafter referred to as liquid crystal display devices).

In the liquid crystal display device, several tens thousand to several million TFTs are arranged in matrix form in a pixel portion, and an electric charge going in and out of a pixel electrode connected to each TFT is controlled by a switching function of the TFT, so that an image is displayed.

Conventionally, thin film transistors using amorphous silicon formed on a glass substrate are arranged in the pixel portion.

A structure has come to be known in recent years in which quartz is utilized as a substrate and thin film transistors are fabricated from a polycrystalline silicon film. In this case, both of a peripheral driving circuit and the pixel portion are formed integrally on the quartz substrate.

Also known recently is a technique in which thin film transistors using a crystalline silicon film are formed on a glass substrate by laser annealing or other technologies.

FIG. 17 is a schematic structural view of a conventional active matrix type liquid crystal display device. In FIG. 17, reference numeral 20000 designates a source driver; 21000, a gate driver; and 22000, a pixel portion. The pixel portion 22000 is a circuit in which a plurality of TFTs 22100 are arranged in matrix form. Gate signal lines (G1, G2, . . . , G480) and source signal lines (S1, S2, . . . , S640) are respectively connected to gate electrodes and source electrodes of the pixel TFTs 22100. A pixel electrode is connected to a drain electrode of the TFT 22100. Reference numeral 22400 designates a storage capacitor. Here, the pixel portion includes (480×640) pixels. For convenience of explanation, symbols of (1, 1) to (480, 640) are given to the respective pixels.

In general, a substrate including a driving circuit and a pixel portion is called an active matrix substrate. A liquid crystal 22300 is held between the active matrix substrate and an opposite substrate (not shown) on one surface of which an opposite electrode is formed.

In the conventional active matrix type liquid crystal display device shown in FIG. 17, a clock signal (CK), a clock back signal (CLKB), a start pulse (SP), and a video signal (VIDEO) are inputted to the source driver, and a clock signal (CK), a clock back signal (CLKB), and a start pulse (SP) are inputted to the gate driver from the external.

Next, reference will be made to FIG. 18. FIG. 18 shows an operation timing chart of the conventional active matrix type liquid crystal display device shown in FIG. 17.

In the conventional active matrix type liquid crystal display device, the source driver 20000 sequentially generates timing signals in accordance with the clock signal (CLK), the clock back signal (CLKB), and the start pulse (SP), and outputs the timing signal to a sampling circuit in the source driver. The sampling circuit samples the externally inputted video signal (VIDEO) on the basis of the timing signal, and outputs to the corresponding source signal lines (S1, S2, . . . , S640).

Selection signals are sequentially supplied from the gate driver 21000 to the gate signal lines (G1, G2, . . . , G480). All TFTs connected to the gate signal line to which the selection signal is supplied are turned ON, and the source driver sequentially supplies the video signals to the source signal lines, so that an image signal is written in the TFT (that is, the liquid crystal and storage capacitor). Note that after the input of the selection signal to the gate signal line G1 is completed, the input of the selection signal of the gate signal line G2 is started. Then, after the input of the selection signal to the gate signal line G2 is completed, the input of the selection signal to the gate signal line G3 is started. In this way, the selection signals are sequentially inputted to the gate signal lines G1 to G480, and one frame period (TF) is completed.

For example, when the selection signal is inputted to the gate signal line G1, video signals (1, 1), (1, 2), . . . , (1, 640) are respectively inputted to the pixels (1, 1), (1, 2), . . . , (1, 640) connected to the source signal lines (S1, S2, . . . , S640). A period during which the video signals (1, 1), (1, 2), . . . , (1, 640) are inputted is called one line period ($T_L$), and a period to a next one line period is called a horizontal retrace period ($T_H$).

In such a conventional dot sequential active matrix type liquid crystal display device, since a load capacitor of the source signal line is large, it takes a time to write the video signal into the source signal line. Besides, since a time spent for writing the video signal into a storage capacitor of a pixel while the selection signal is inputted to the gate signal line varies for every pixel, especially in a pixel (for example, (1, 639), (1, 640), etc.) near the end of the selection signal, writing of the video signal into the storage capacitor of the pixel is made only in a part of the horizontal retrace period ($T_H$). Thus, writing of the video signal is not sufficiently made into the storage capacitor of such a pixel, and as a result, degradation of display quality is caused.

As has just been described, there is fluctuation in a writing period of a video signal into a storage capacitor depending on in which pixel the signal is written, and hence some pixels are not allowed to have sufficient writing period.

SUMMARY OF THE INVENTION

The present invention has been made in view of the above problems, and provides an active matrix type liquid crystal display device in which every pixel can realize sufficient writing of a video signal into a storage capacitor and a high quality image can be displayed.

The liquid crystal display device of the present invention includes left and right gate drivers. The left gate driver is connected to supply selection signals to TFTs of pixels of a left half of a pixel portion. The right gate driver is connected to supply selection signals to TFTs of pixels of a right half of the pixel portion.

In the liquid crystal display device of the present invention, timing when the left gate driver outputs a selection signal to a gate signal line connected to a pixel of a column is different from timing when the right gate driver outputs a selection signal to a gate signal line connected to a pixel of the same row as the aforementioned pixel.

A liquid crystal display device of the present invention will be described with reference to FIG. 1.

FIG. 1 is a schematic structural view of a liquid crystal display device 1000 of the present invention. In FIG. 1, reference numeral 1100 designates a source driver; 1200, a first gate driver L; 1300, a second gate driver R; and 1400, a pixel portion. The source driver 1100 generally includes a shift register circuit, a sampling circuit, a buffer circuit, a level shifter circuit, and the like (none of which is shown). The first gate driver L 1200 and the second gate driver R 1300 each include a shift register circuit, a buffer circuit, a level shifter circuit, and the like (none of which is shown). The pixel portion 1400 is a circuit in which a plurality of TFTs 1401 are arranged in matrix form. For convenience of explanation, symbols of (1, 1) to (4, 4) are given to the respective pixels.

The first gate driver L 1200 supplies selection signals to first gate signal lines G1L, G2L, G3L and G4L. The gate signal line G1L is connected to the gate electrodes of the TFTs of the pixel (1, 1) and the pixel (1, 2). The gate signal line G2L is connected to the gate electrodes of the TFTs of the pixel (2, 1) and the pixel (2, 2). The gate signal line G3L is connected to the gate electrodes of the TFTs of the pixel (3, 1) and the pixel (3, 2). The gate signal line G4L is connected to the gate electrodes of the TFTs of the pixel (4, 1) and the pixel (4, 2).

The second gate driver R 1300 supplies selection signals to second gate signal lines G1R, G2R, G3R and G4R. The gate signal line G1R is connected to the gate electrodes of the TFTs of the pixel (1, 3) and the pixel (1, 4). The gate signal line G2R is connected to the gate electrodes of the TFTs of the pixel (2, 3) and the pixel (2, 4). The gate signal line G3R is connected to the gate electrodes of the TFTs of the pixel (3, 3) and the pixel (3, 4). The gate signal line G4R is connected to the gate electrodes of the TFTs of the pixel (4, 3) and the pixel (4, 4).

Note that the first gate signal line G1L of the first gate driver L1200 is not connected to the second gate signal line G1R of the second gate driver R1300. Also, the first gate signal line G2L is not connected to the second gate signal line G2R. Also, the first gate signal line G3L is not connected to the second gate signal line G3R. Also, the first gate signal line G4L is not connected to the second gate signal line G4R.

The source driver 1100 supplies video signals to source signal lines S1, S2, S3 and S4. The source signal line S1 is connected to source electrodes of TFTs of the pixel (1, 1), pixel (2, 1), pixel (3, 1) and pixel (4, 1). The source signal line S2 is connected to source electrodes of TFTs of the pixel (1, 2), pixel (2, 2), pixel (3, 2) and pixel (4, 2). The source signal line S3 is connected to source electrodes of TFTs of the pixel (1, 3), pixel (2, 3), pixel (3, 3) and pixel (4, 3). The source signal line S4 is connected to source electrodes of TFTs of the pixel (1, 4), pixel (2, 4), pixel (3, 4) and pixel (4, 4).

Note that here, for simplification of explanation, the description is made taking the liquid crystal display device including the pixel portion constituted of (4×4) pixels as an example. However, according to the present invention, it is possible to provide a liquid crystal display device including a pixel portion constituted of (m×2n) pixels (both m and n are natural numbers).

A pixel electrode is connected to a drain electrode of a TFT 1401 of each pixel. Reference numeral 1403 designate a storage capacitor.

In general, a substrate including a driving circuit and a pixel portion is called an active matrix substrate (or a TFT substrate). A liquid crystal 1404 is held between the active matrix substrate and an opposite substrate (not shown) on one surface of which an opposite electrode is formed.

In the active matrix type liquid crystal display device of the present invention shown in FIG. 1, a clock signal (CK), a clock back signal (CLKB) with a reverse phase to the clock signal, a start pulse (SP), a video signal (VIDEO), and the like are inputted to the source driver from the external, and a clock signal (CK), a clock back signal (CLKB), a start pulse (SP), and the like are inputted to the gate driver from the external.

Next, reference will be made to FIG. 2. FIG. 2 shows an operation timing chart of the liquid crystal display device of the present invention shown in FIG. 1.

In the liquid crystal display device of the present invention shown in FIG. 1, the source driver 1100 sequentially generates timing signals in accordance with the clock signal (CLK), the clock back signal (CLKB), the start pulse (SP) and the like, and outputs the timing signal to a sampling circuit in the source driver. The sampling circuit samples the externally inputted video signal (VIDEO) on the basis of the timing signal, and sequentially outputs to the corresponding source signal lines (S1, S2, S3, S4).

In the present specification, a period during which the selection signal is inputted to each of the gate signal lines is called a line period ($T_L$) and a half period of the line period ($T_L$) is called a half line period ($T_{HL}$).

Note that symbols corresponding to the image signals supplied to the respective pixels are given to the video signals (VIDEO) shown in FIG. 2. That is, video signals (1, 1), (1, 2), (1, 3), (1, 4), (2, 1), . . . , (4, 3), and (4, 4) are supplied to and written in the pixel (1, 1), pixel (1, 2), pixel (1, 3), pixel (1, 4), pixel (2, 1), . . . , pixel (4, 3), and pixel (4, 4).

The flow of the respective signals will be described below.

First, a selection signal is inputted to the gate signal line G1L. When the selection signal is inputted to the gate signal line G1L, the selection signal is applied to the gate electrodes of the TFTs of the pixel (1, 1) and the pixel (1, 2) which are connected to the gate signal line G1L.

The video signal (1, 1) is inputted to the source signal line S1 in the half line period ($T_{HL}$) subsequent to the start of the selection signal input to the gate signal line G1L and the video signal (1, 1) is written in the storage capacitor of the pixel (1, 1). After the input of the video signal (1, 1), the video signal (1, 2) is inputted to the source signal line S2, and the video signal (1, 2) is written in the storage capacitor of the pixel (1, 2). Then, after completion of the half line period ($T_{HL}$) subsequent to the start of the selection signal input to the gate signal line G1L, a selection signal is inputted to the gate signal line G1R. When the selection signal is inputted to the gate signal line G1R, the selection signal is applied to the gate electrodes of the TFTs of the pixel (1, 3) and the pixel (1, 4) which are connected to the gate signal line G1R.

The video signal (1, 3) is inputted to the source signal line S3 in the half line period ($T_{HL}$) subsequent to the start of the selection signal input to the gate signal line G1R and the video signal (1, 3) is written in the storage capacitor of the pixel (1, 3). After the input of the video signal (1, 3), the video signal (1, 4) is inputted to the source signal line S4, and the video signal (1, 4) is written in the storage capacitor of the pixel (1, 4).

Note that in the half line period ($T_{HL}$) subsequent to the start of the selection signal input to the gate signal line G1R, the selection signal is kept inputted to the gate signal line G1L, and the selection signal is kept applied to the gate electrodes of the TFTs of the pixel (1, 1) and the pixel (1, 2).

After completion of the half line period ($T_{HL}$) subsequent to the start of the selection signal input to the gate signal line G1R, a selection signal is inputted to the gate signal line G2L. When the selection signal is inputted to the gate signal line G2L, the selection signal is applied to the gate electrodes of the TFTs of the pixel (2, 1) and the pixel (2, 2) which are connected to the gate signal line G2L.

The video signal (2, 1) is inputted to the source signal line S1 in the half line period (THE) subsequent to the start of the selection signal input to the gate signal line G2L and the video signal (2, 1) is written in the storage capacitor of the pixel (2, 1). After the input of the video signal (2, 1), the video signal (2, 2) is inputted to the source signal line S2, and the video signal (2, 2) is written in the storage capacitor of the pixel (2, 2).

Note that in the half line period ($T_{HL}$) subsequent to the start of the selection signal input to the gate signal line G2L, the selection signal is kept inputted to the gate signal line G1R, and the selection signal is kept applied to the gate electrodes of the TFTs of the pixel (1, 3) and the pixel (1, 4).

After completion of the half line period ($T_{HL}$) subsequent to the start of the selection signal input to the gate signal line G2L, a selection signal is inputted to the gate signal line G2R. When the selection signal is inputted to the gate signal line G2R, the selection signal is applied to the gate electrodes of the TFTs of the pixel (2, 3) and the pixel (2, 4) which are connected to the gate signal line G2R.

The video signal (2, 3) is inputted to the source signal line S3 in the half line period ($T_{HL}$) subsequent to the start of the selection signal input to the gate signal line G2R and the video signal (2, 3) is written in the storage capacitor of the pixel (2, 3). After the input of the video signal (2, 3), the video signal (2, 4) is inputted to the source signal line S4, and the video signal (2, 4) is written in the storage capacitor of the pixel (2, 4).

Note that in the half line period ($T_{HL}$) subsequent to the start of the selection signal input to the gate signal line G2R, the selection signal is kept inputted to the gate signal line G2L, and the selection signal is kept applied to the gate electrodes of the TFTs of the pixel (2, 1) and the pixel (2, 2).

Generally speaking, in the liquid crystal display device, the load capacitor of a gate signal line and a source signal line is large, selection of the gate signal line in a short period is not sufficient to write a video signal in a liquid crystal and a storage capacitor which are connected to a TFT. However, in the liquid crystal display device of the present invention, since the selection signal is kept inputted to the gate signal line after the video signal is inputted to the source signal line, even in the case where the load capacitor of the gate signal line and the source signal line is very large, it is possible to gain a time sufficient to write the video signal in the liquid crystal and the storage capacitor.

For example, FIG. 19 shows a timing chart in the case where load capacitor of a gate signal line is large, and it takes a considerable time for a potential to rise and fall by a selection signal of the gate signal line. As shown in FIG. 19, it takes a rise time (Tr) until the gate signal line reaches a desired potential by the selection signal inputted to the gate signal line, and it takes a fall time (Ts) until the gate signal line reaches a desired potential after the selection signal is inputted to the gate signal line. However, by using the present invention, it is possible to input the selection signal in view of the rise time (Tr) and the fall time (Ts) of the gate signal line. That is, it is designed such that after the potential by the selection signal of the gate signal line G1L sufficiently falls, the potential by the selection signal of the gate signal line G2L sufficiently rises.

Besides, even if the operation speed of the TFT of the pixel is slow, it is possible to gain a time sufficient to write the video signal in the liquid crystal and the storage capacitor.

Further, since the ratio (holding period/writing period) in writing period to a storage capacitor of pixel-holding period can be made lower than the prior art, a demand to an ON-OFF ratio of a TFT of a pixel is moderated.

Here, the structure of the present invention will be explained below.

According to a first aspect of the present invention, there is provided a liquid crystal display device comprising:

a pixel portion in which (m×2n) pixels, each including a TFT, are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GmL; and a second gate driver for supplying selection signals to m second gate signal lines G1R, G2R, . . . , GmR, characterized in that:

the pixels connected to the source signal lines S1, S2, Sn are supplied with the selection signals from the first gate signal lines G1L, G2L, . . . , GmL;

the pixels connected to the source signal lines Sn+1, SN+2, . . . , S2*n* are supplied with the selection signals from the second gate signal lines G1R, G2R, . . . , GmR;

the selection signal starts to be supplied to the second gate signal line G1R while the selection signal is supplied to the first gate signal line G1L; and the selection signal starts to be supplied to the first gate signal line G2L while the selection signal is supplied to the second gate signal G1R.

According to a second aspect of the present invention, there is provided a liquid crystal display device comprising:

a pixel portion in which (m×2n) pixels, each including a TFT, are arranged in matrix form (both m and n are natural numbers);

a source driver for supplying video signals to 2 n source signal lines S1, S2, Sn, Sn+1, Sn+2, . . . , S2*n;* a first gate driver for supplying selection signals to m first gate signal lines G1L, G2L, . . . , GmL; and a second gate driver for supplying selection signals to m second gate signal lines G1R, G2R, . . . , GmR, characterized in that:

the pixels connected to the source signal lines S1, S2, . . . , Sn are supplied with the selection signals from the first gate signal lines G1L, G2L, . . . , GmL;

the pixels connected to the source signal lines Sn+1, Sn+2, . . . , S2*n* are supplied with the selection signals from the second gate signal lines G1R, G2R, GmR; and the selection signals are sequentially supplied to the first gate signal line G1L, the second gate signal line G1R, the first gate signal line G21, the second gate signal line G2R, . . . , the first gate signal line GmL, and the second gate signal line GmR in this order with a delay of a half period between the respective adjacent gate signal lines.

BRIEF DESCRIPTION OF THE DRAWINGS

In the accompanying drawings:

FIGS. 13A and 13B are sectional views each showing a liquid crystal display device of the present invention;

DETAILED DESCRIPTION OF THE PREFERRED EMBODIMENTS

An embodiment mode for carrying out the present invention will be described below.

Figure 1:
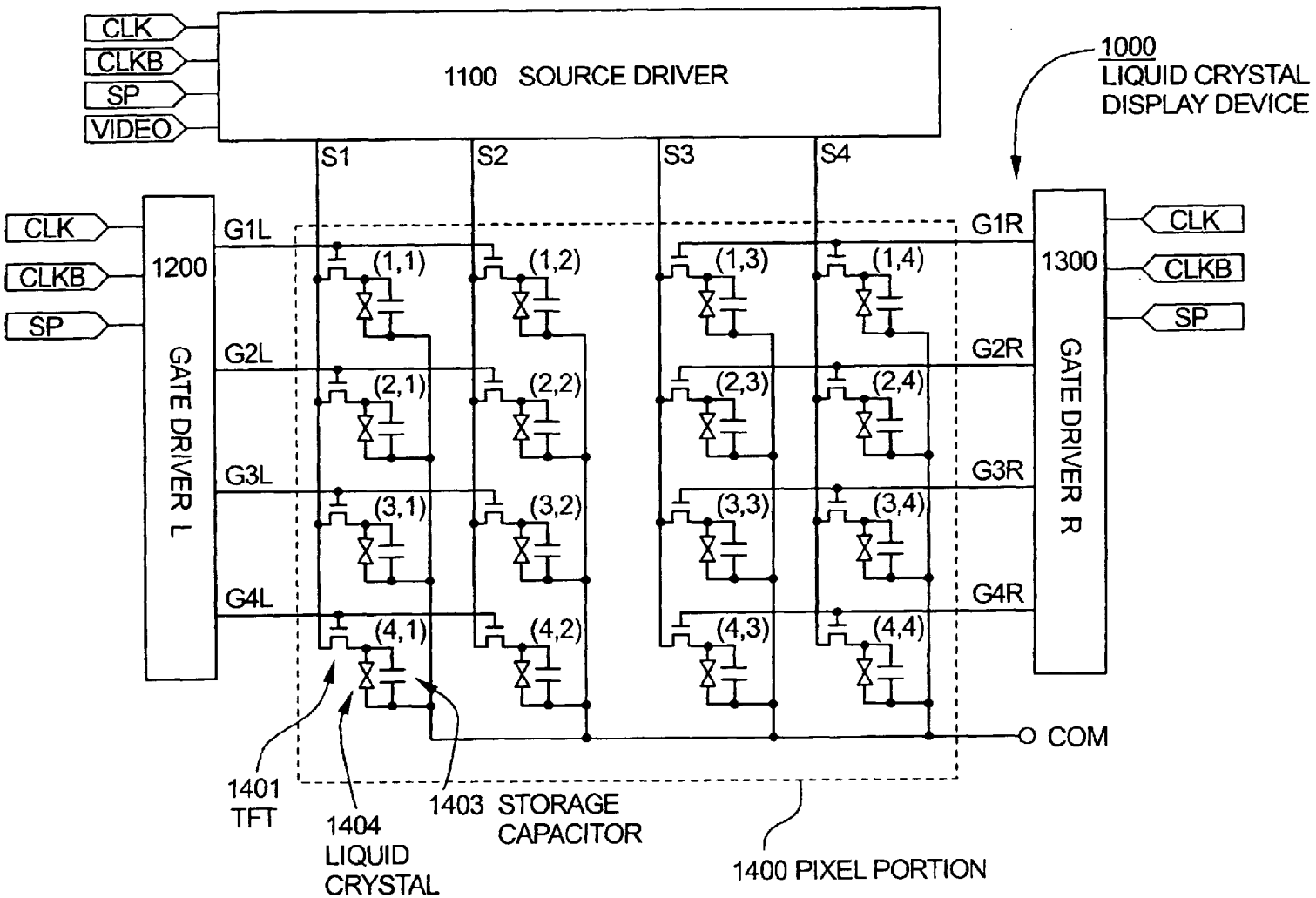
FIG. 1 is a schematic structural view of a liquid crystal display device of the present invention.
Figure 2:
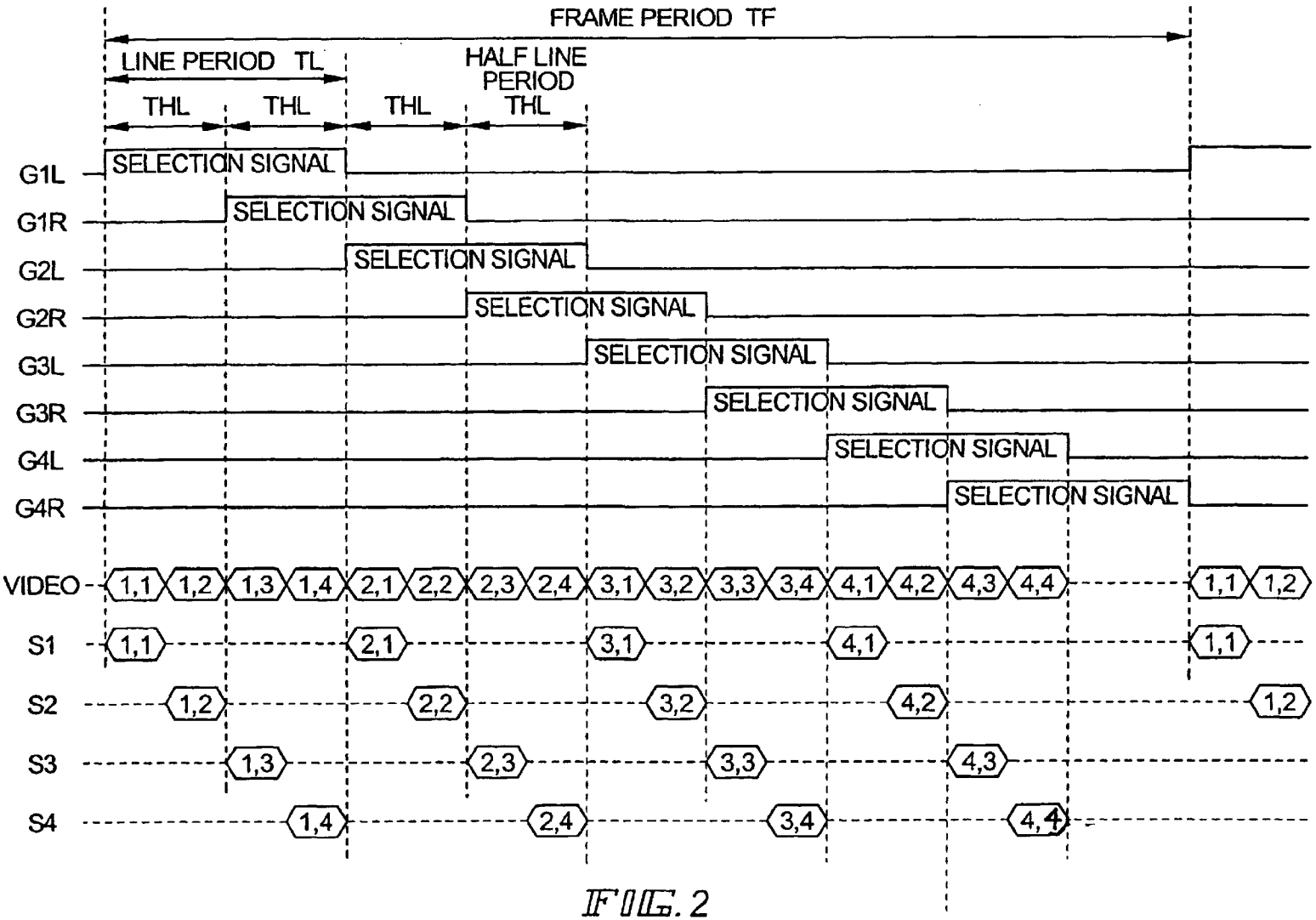
FIG. 2 is a driving timing chart of the liquid crystal display device of the present invention.
Figure 3:
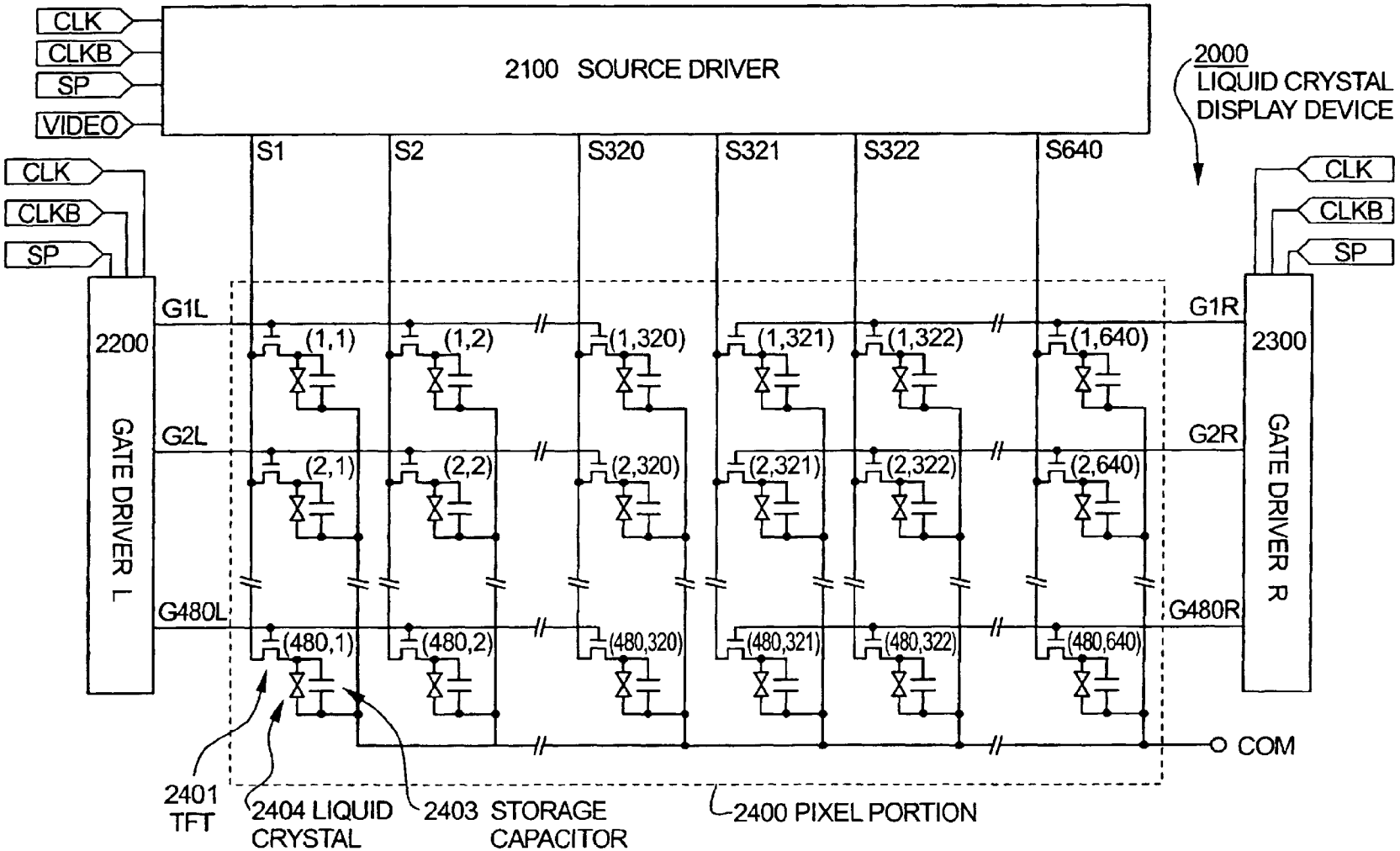
FIG. 3 is a schematic structural view of a liquid crystal display device of the present invention.
Figure 4:
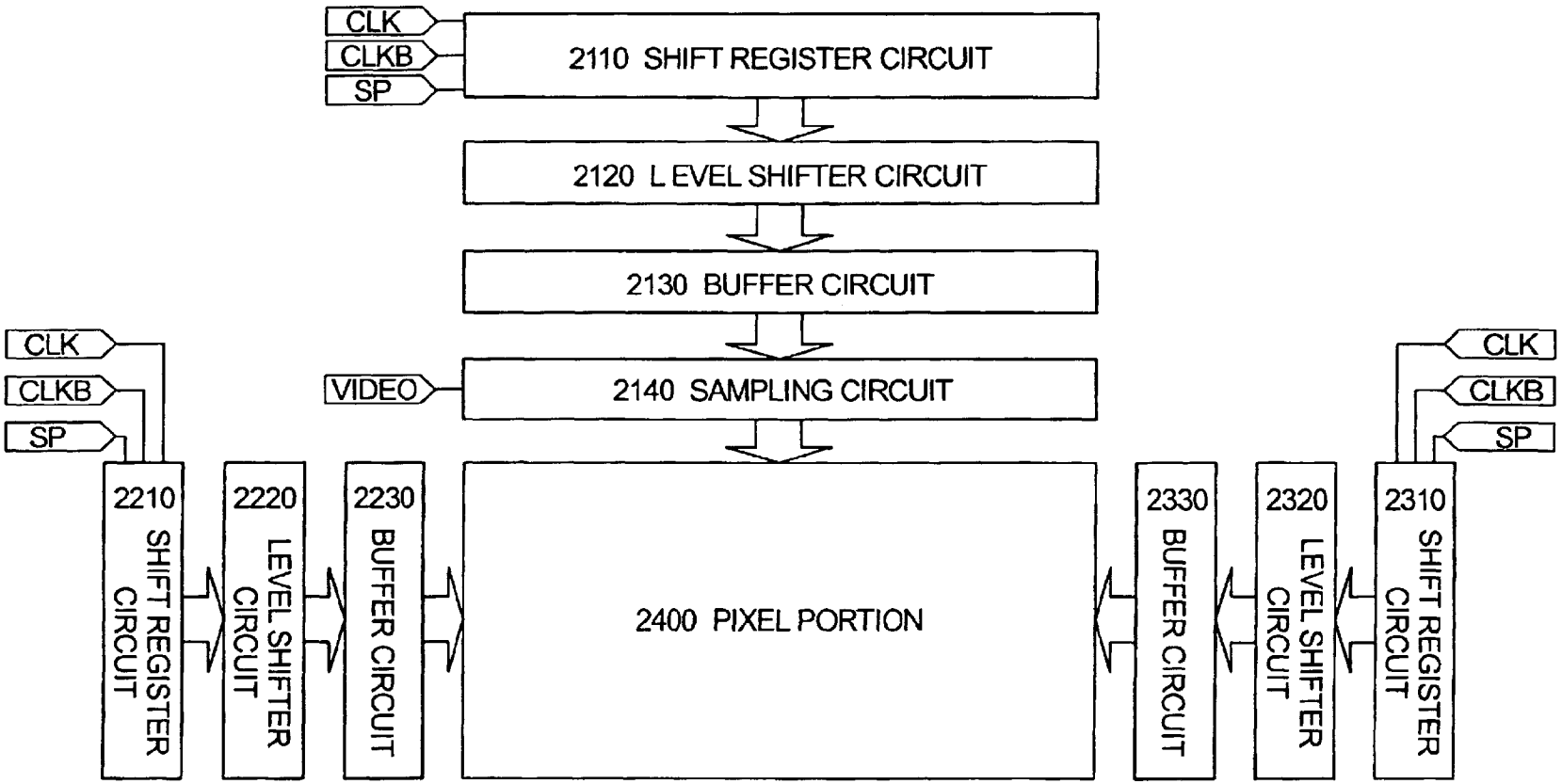
FIG. 4 is a block diagram showing a schematic structure of a liquid crystal display device of the present invention.

Reference will be made to FIG. 3. FIG. 3 is a schematic structural view of a liquid crystal display device 2000 of the present invention. In FIG. 3, reference numeral 2100 designates a source driver; 2200, a gate driver L; 2300, a gate driver R; and 2400, a pixel portion. As shown in FIG. 4, the source driver 2100 includes a shift register circuit 2110, a level shifter circuit 2120, a buffer circuit 2130, and a sampling circuit 2140. The gate driver L 2200 includes a shift register circuit 2210, a level shifter circuit 2220, and a buffer circuit 2230. The gate driver R 2300 includes a shift register circuit 2310, a level shifter circuit 2320, and a buffer circuit 2330. The pixel portion 2400 is a circuit in which a plurality of TFTs 2401 are arranged in matrix form. For convenience of explanation, symbols of (1, 1) to (480, 640) are given to the respective pixels.

The gate driver L 2200 supplies selection signals to gate signal lines G1L, G2L, . . . , G480L. The gate signal line G1L is connected to gate electrodes of TFTs of the pixel (1, 1), pixel (1, 2), . . . , pixel (1, 319), and pixel (1, 320). The gate signal line G2L is connected to gate electrodes of TFTs of the pixel (2, 1), pixel (2, 2), . . . , pixel (2, 319), and pixel (2, 320). The gate signal line G480L is connected to gate electrodes of TFTs of the pixel (480, 1), pixel (480, 2), . . . , pixel (480, 319), and pixel (480, 320). The not-shown gate signal lines G3L to G479L are also connected to gate electrodes of TFTs in the same way.

The gate driver R 2300 supplies selection signals to gate signal lines G1R, G2R, G479R, and G480R. The gate signal line G1R is connected to gate electrodes of TFTs of the pixel (1, 321), pixel (1, 322), . . . , pixel (1, 639), and pixel (1, 640). The gate signal line G2R is connected to gate electrodes of TFTs of the pixel (2, 321), pixel (2, 322), . . . , pixel (2, 639), and pixel (2, 640). The gate signal line G480R is connected to gate electrodes of TFTs of the pixel (480, 321), pixel (480, 322), . . . , pixel (480, 639), and pixel (480, 640). The not-shown gate signal lines G3R to G479R are also connected to gate electrodes of TFTs in the same way.

Note that the gate signal line G1L of the gate driver L 2200 is not connected to the gate signal line G1R of the gate driver R 2300. Also, the gate signal line G2L is not connected to the gate signal line G2R. Also, the gate signal line 480L is not connected to the gate signal line G480R. The same is the case with the relation between the not-shown gate signal lines G3L to G479L and the gate signal lines G3R to G479R.

The source driver 2100 supplies video signals to source signal lines S1, S2, S639 and S640. The source signal line S1 is connected to source electrodes of the TFTs of the pixel (1, 1), pixel (2, 1), pixel (3, 1), . . . , pixel (479, 1), and pixel (480, 1). The source signal line S2 is connected to source electrodes of the TFTs of the pixel (1, 2), pixel (2, 2), pixel (3, 2), . . . , pixel (479, 2), and pixel (480, 2). The source signal line S640 is connected to source electrodes of the TFTs of the pixel (1, 640), pixel (2, 640), pixel (3, 640), . . . , pixel (479, 640), and pixel (480, 640). The not-shown source signal lines S3 to S639 also have the same connection structure.

Figure 6:
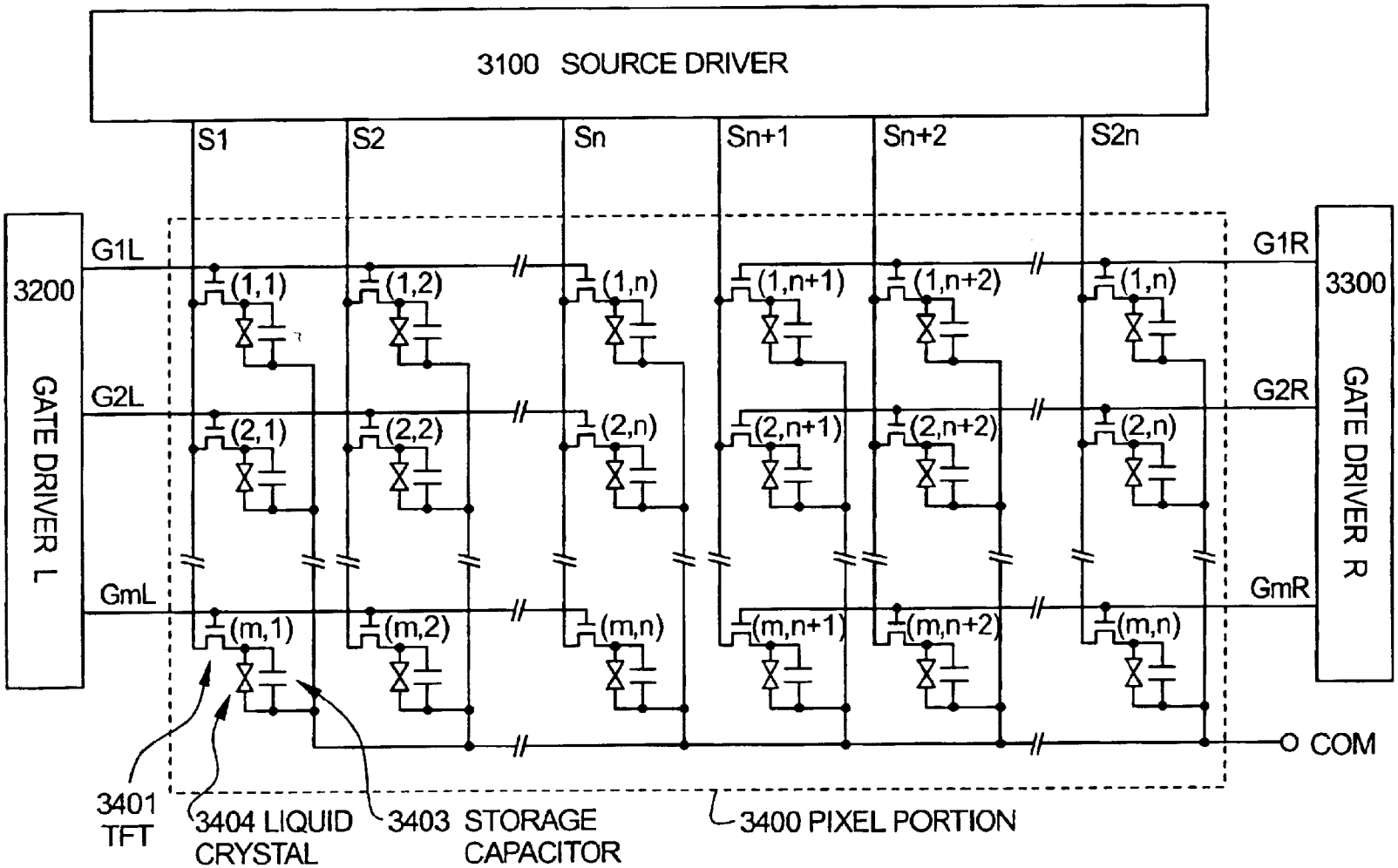
FIG. 6 is a block diagram showing a schematic structure of a liquid crystal display device of the present invention.
Figure 7:
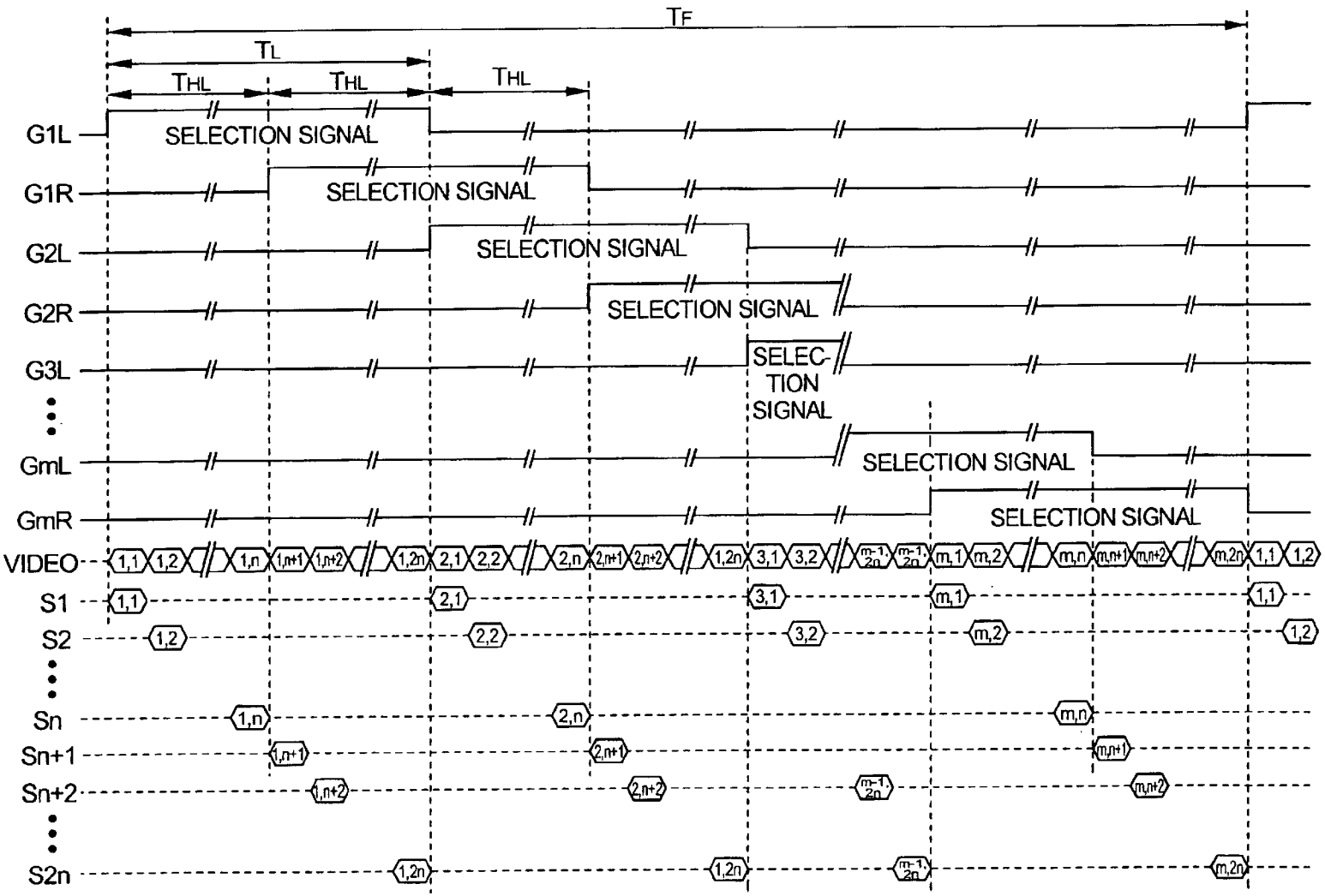
FIG. 7 is a driving timing chart of a liquid crystal display device of the present 1, invention.

Note that here, for simplification of explanation, the description is made taking the liquid crystal display device including the pixel portion constituted of (480×640) pixels as an example. However, according to the present invention, it is possible to provide a liquid crystal display device including a pixel portion constituted of (m×2n) pixels (both m and n are positive integers). Note that FIGS. 6 and 7 show an example of a liquid crystal display device including a pixel portion constituted of (m×2n) pixels and an operation timing chart thereof, respectively.

In the active matrix type liquid crystal display device of the present invention shown in FIG. 3, a clock signal (CK), a clock back signal (CLKB) with a reverse phase to the clock signal, a start pulse (SP), a video signal (VIDEO), and the like are inputted to the source driver 2100 from the external, and a clock signal (CK), a clock back signal (CLKB), a start pulse (SP), and the like are inputted to the gate driver L 2200 and the gate driver R 2300 from the external.

Figure 5:
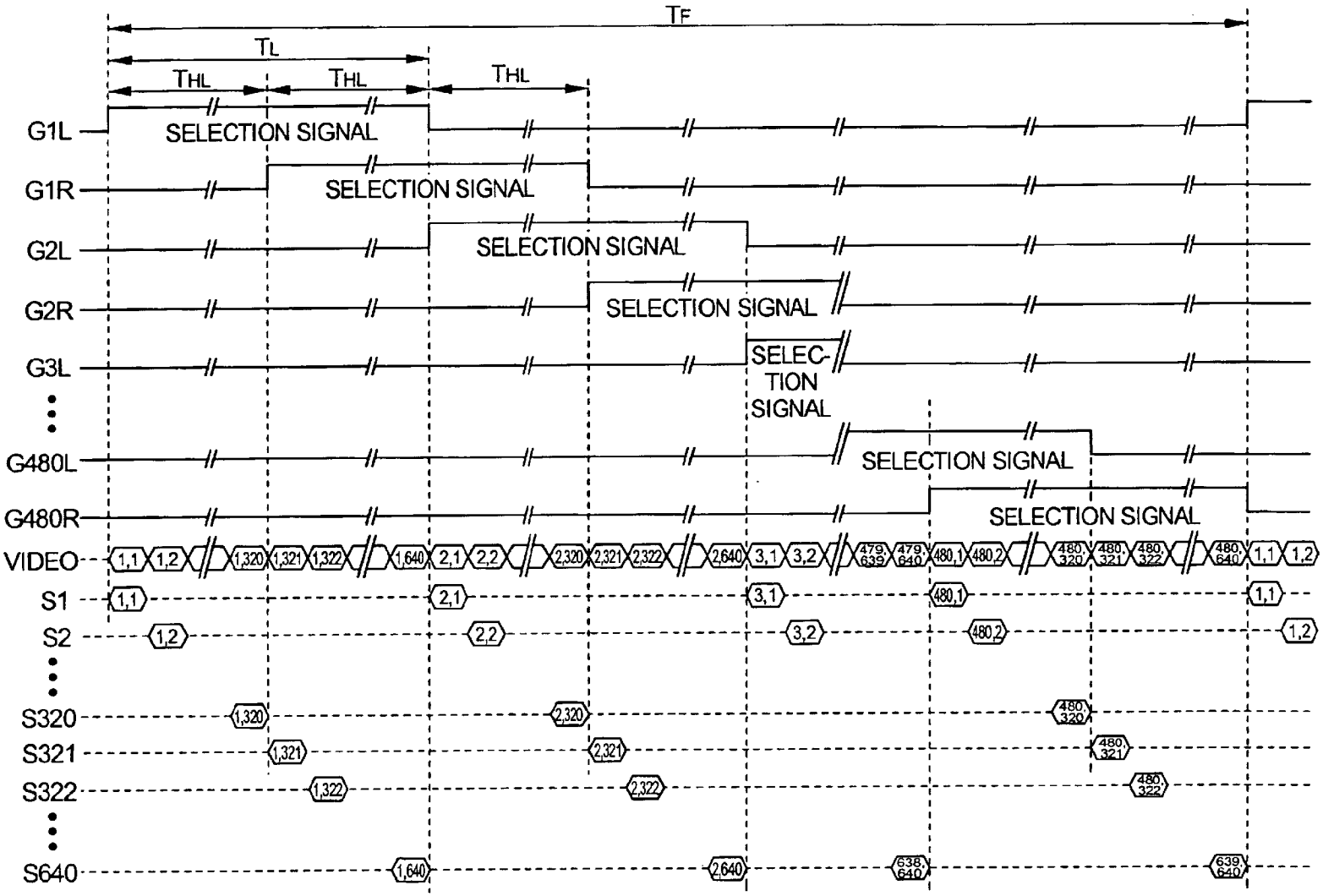
FIG. 5 is a driving timing chart of a liquid crystal display device of the present invention.

Next, reference will be made to FIG. 5. FIG. 5 shows an operation timing chart of the liquid crystal display device of the present invention. Symbols corresponding to the image signals supplied to the respective pixels are given to the video signals (VIDEO) shown in FIG. 5.

The flow of the respective signals will be described below.

First, a selection signal is inputted to the gate signal line G1L. When the selection signal is inputted to the gate signal line G1L, the selection signal is applied to the gate electrodes of the TFTs of the pixel (1, 1), pixel (1, 2), . . . , pixel (1, 319) and pixel (1, 320) which are connected to the gate signal line G1L.

The video signals (VIDEO) are sequentially inputted to the source signal lines S1 to S320 in a half line period ($T_{HL}$) subsequent to the start of the selection signal input to the gate signal line G1L. That is, in the half line period ($T_{HL}$) subsequent to the start of the selection signal input to the gate signal line G1L, the video signal (1, 1) is inputted to the source signal line S1, and the video signal (1, 1) is written in the liquid crystal and the storage capacitor of the pixel (1, 1), and then, the video signal (1, 2) is inputted to the source signal line S2, and the video signal (1, 2) is written in the liquid crystal and the storage capacitor of the pixel (1, 2). The video signals are thus sequentially written in the source signal lines. Then, the video signal (1, 320) is inputted to the source signal line S320, and the video signal (1, 320) is written in the liquid crystal and the storage capacitor of the pixel (1, 320), so that the half line period ($T_{HL}$) subsequent to the start of the selection signal input to the gate signal line G1L is completed.

After completion of the half line period ($T_{HL}$) subsequent to the start of the selection signal input to the gate signal line G1L, a selection signal is inputted to the gate signal line G1R. In a half line period ($T_{HL}$) subsequent to the start of the selection signal input to the gate signal line G1R, the video signals (VIDEO) are inputted to the source signal lines S321 to S640. That is, in the half line period ($T_{HL}$) subsequent to the start of the selection signal input to the gate signal line G1R, the video signal (1, 321) is inputted to the source signal line S321, and the video signal (1, 321) is written in the liquid crystal and the storage capacitor of the pixel (1, 321), and then, the video signal (1, 322) is inputted to the source signal line S322, and the video signal (1, 322) is written in the liquid crystal and the storage capacitor of the pixel (1, 322). The video signals are thus sequentially written in the source signal lines. Then, the video signal (1, 640) is inputted to the source signal line S640, and the video signal (1, 640) is written in the liquid crystal and the storage capacitor of the pixel (1, 640), so that the half line period ($T_{HL}$) subsequent to the start of the selection signal input to the gate signal line G1R is completed.

Note that in the half line period ($T_{HL}$) subsequent to the start of the selection signal input to the gate signal line G1R, the selection signal is kept inputted to the gate signal line G1L, and the selection signal is kept applied to the gate electrodes of the TFTs of the pixel (1, 1), pixel (1, 2), . . . , pixel (1, 319) and pixel (1, 320).

After completion of the half line period ($T_{HL}$) subsequent to the start of the selection signal input to the gate signal line G1R, a selection signal is inputted to the gate signal line G2L. In a half line period ($T_{HL}$) subsequent to the start of the selection signal input to the gate signal line G2L the video signals (VIDEO) are inputted to the source signal lines S1 to S320. That is, in the half line period ($T_{HL}$) subsequent to the start of the selection signal input to the gate signal line G2L, the video signal (2, 1) is inputted to the source signal line S1, and the video signal (2, 1) is written in the liquid crystal and the storage capacitor of the pixel (2, 1), and then, the video signal (2, 2) is inputted to the source signal line S2, and the video signal (2, 2) is written in the liquid crystal and the storage capacitor of the pixel (2, 2). The video signals are thus sequentially written in the source signal lines. Then, the video signal (2, 320) is inputted to the source signal line S320, and the video signal (2, 320) is written in the liquid crystal and the storage capacitor of the pixel (2, 320), so that the half line period ($T_{HL}$) subsequent to the start of the selection signal input to the gate signal line G2L is completed.

Note that in the half line period ($T_{HL}$) subsequent to the start of the selection signal input to the gate signal line G2L, the selection signal is kept inputted to the gate signal line G1R, and the selection signal is kept applied to the gate electrodes of the TFTs of the pixel (1, 321), pixel (1, 322), . . . , pixel (1, 639) and pixel (1, 640).

Hereinafter, embodiments of the present invention will be described.

Embodiment 1

In this embodiment, an example of a fabricating process of a liquid crystal display device including a driving circuit of the present invention will be described with reference to FIGS. 8A to 12. In the liquid crystal display device of this embodiment, a pixel portion, a source driver, a gate driver, and the like are integrally formed on one substrate. Note that for convenience of explanation, shown here is a case in which a pixel TFT, an n-channel TFT constituting a part of the driving circuit, a p-channel TFT and an n-channel TFT constituting an inverter circuit are formed on the same substrate.

Figure 8A:
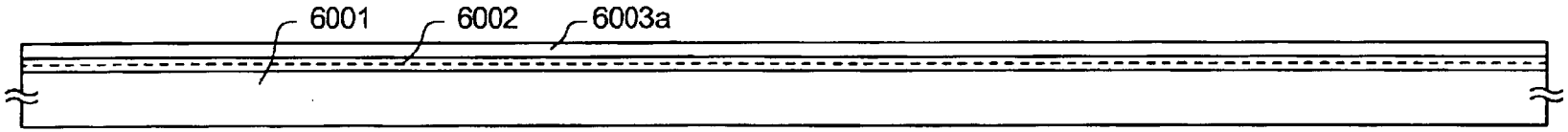
FIGS. 8A to 8D are views showing an example of a fabricating process of a liquid crystal display device using a driving circuit of the present invention.

In FIG. 8A, a low alkali glass substrate or a quartz substrate can be used as a substrate 6001. In this embodiment, a low alkali glass substrate is used as the substrate 6001. In this case, the glass substrate may be thermally treated in advance at a temperature lower than the glass distortion point by 10 to 20° C. On the surface of the substrate 6001 where the TFTs are to be formed, for the purpose of preventing impurity diffusion from the substrate 6001, an base film 6002 of silicon oxide film, silicon nitride film, silicon nitride oxide film, or the like is formed. For example, a silicon nitride oxide film formed from $SiH_4$, $NH_3$, and $N_2O$ may be formed by plasma CVD to a thickness of 100 nm, and a silicon nitride oxide film formed from $SiH_4$ and $N_2O$ may be formed similarly to a thickness of 200 nm to form lamination.

Next, a semiconductor film 6003*a* having the amorphous structure is formed by a known method such as plasma CVD or sputtering to a thickness of from 20 to 150 nm (preferably 30 to 80 nm). In this embodiment, an amorphous silicon film is formed by plasma CVD to a thickness of 54 nm. Such semiconductor films having the amorphous structure include amorphous semiconductor films, microcrystalline semiconductor films, and the like, and a compound semiconductor film having the amorphous structure such as an amorphous silicon germanium film may also be used. Further, since the base film 6002 and an amorphous silicon film 6003*a* can be formed using the same film forming method, the two may be continuously formed. By not exposing the substrate to the atmosphere after the base film is formed thereon, contamination of the surface can be prevented, and thus, variation in the characteristics of the TFTs to be formed thereon and variation in the threshold voltage can be decreased (FIG. 8A).

Figure 8B:
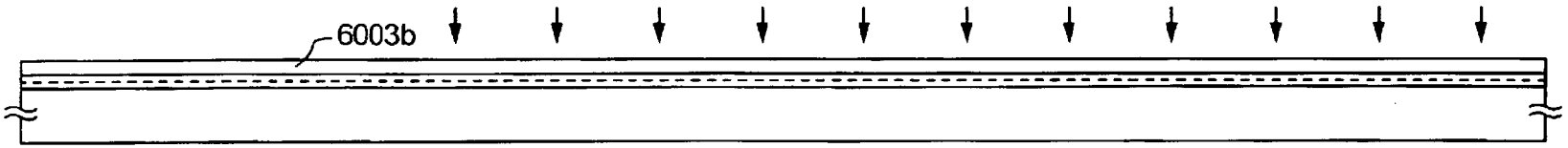

Then, using known crystallization technique, a crystalline silicon film 6003*b* is formed from the amorphous silicon film 6003*a*. For example, laser crystallization or thermal crystallization (solid phase growth method) may be used. Here, according to the technique disclosed in Japanese Patent Application Laid-open No. Hei 7-130652, with the crystallization method using a catalytic element, the crystalline silicon film 6003*b* is formed. Prior to the crystallization step, it is preferable to, though depending on the amount of hydrogen contained in the amorphous silicon film, carry out heat treatment at 400 to 500° C. for about an hour to make the amount of hydrogen contained to be 5 atomic % or less. Since the atoms are rearranged to be denser when the amorphous silicon film is crystallized, the thickness of the crystalline silicon film to be formed is reduced from that of the original amorphous silicon film (54 nm in this embodiment) by 1 to 15% (FIG. 8B).

Figure 8C:
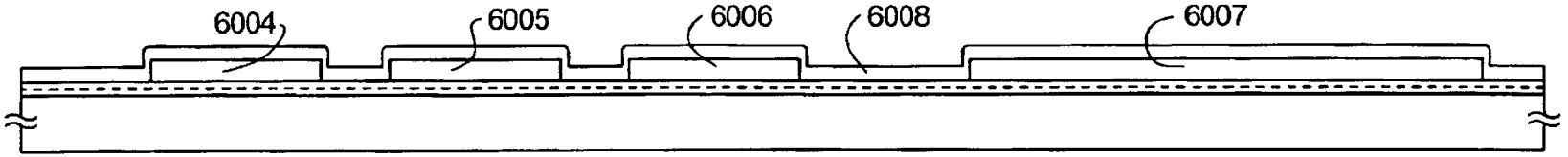

Then, the crystalline silicon film 6003*b* is patterned to have an island shape to form island-like semiconductor layers 6004 to 6007. After that, a mask layer 6008 is formed of silicon oxide film by plasma CVD or sputtering to a thickness of from 50 to 150 nm (FIG. 8C). In this embodiment, the thickness of the mask layer 6008 is 130 nm.

Next, a resist mask 6009 is provided and boron (B) is doped all over the surfaces of island-like semiconductor layers 6005 to 6007 for forming n-channel TFTs as an impurity element imparting p-type conductivity at the concentration of from about $1\times10^{16}$ to $5\times10^{17}$ atoms/cm$^3$. This boron (B) doping is made for the purpose of controlling the threshold voltage. Boron (B) may be doped by ion doping, or, alternatively, may be doped simultaneously with the formation of the amorphous silicon film. The boron (B) doping here is not always needed (FIG. 8D).

Figure 9A:
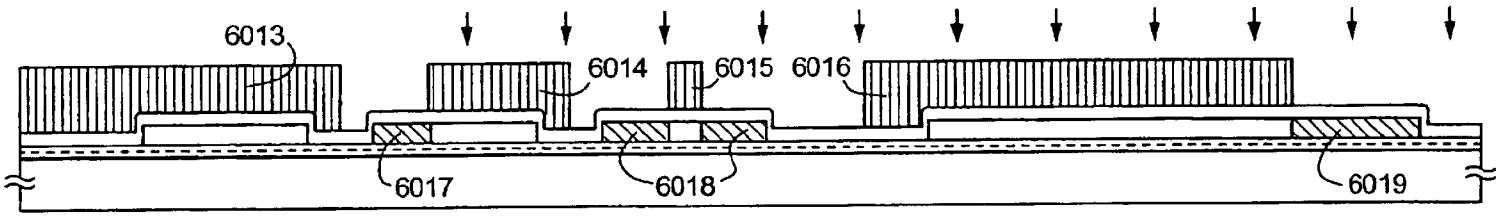
FIGS. 9A to 9D are views showing the fabricating process example of the liquid crystal display device of the present invention.

For the purpose of forming the LDD regions of the n-channel TFTs of the driving circuit such as a driver, an impurity element imparting n-type conductivity is selectively doped in the island-like semiconductor layers 6010 to 6012, which requires the formation of resist masks 6013 to 6016 in advance. As the impurity element imparting n-type conductivity, phosphorus (P) or arsenic (As) may be used. Here, ion doping with phosphine ($PH_3$) is used to dope phosphorus (P). The appropriate concentration of phosphorus (P) in formed impurity regions 6017 and 6018 is in the range of from $2\times10^{16}$ to $5\times10^{19}$ atoms/cm$^3$. Herein, the concentration of the impurity element imparting n-type conductivity contained in impurity regions 6017 to 6019 formed here is referred to as ($n^-$). An impurity region 6019 is a semiconductor layer for forming the storage capacitor of the pixel portion. Phosphorus (P) at the same concentration is also doped in this region (FIG. 9A). After that, the resist masks 6013 to 6016 are removed.

Figure 8D:
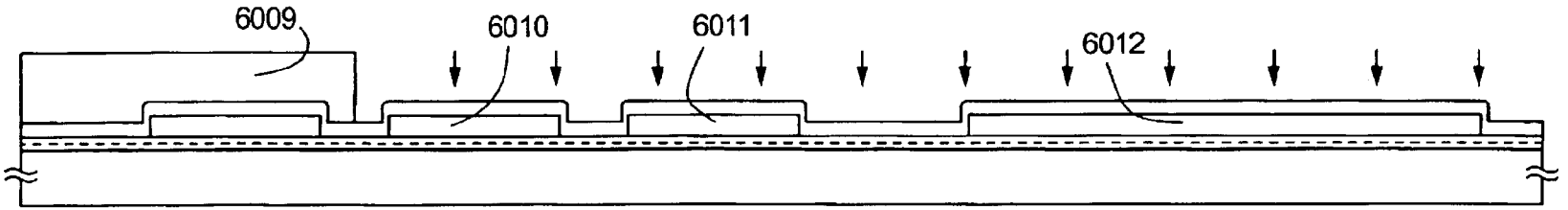

Next, the mask layer 6008 is removed with fluoric acid or the like and an activation step for the impurity elements doped in FIGS. 8D and 9A is carried out. The activation can be carried out by heat treatment in a nitrogen atmosphere at 500 to 600° C. for 1 to 4 hours or by laser activation. Alternatively, the two may be used jointly. In this embodiment, laser activation is adopted and KrF excimer laser light (wavelength: 248 nm) is used to form linear beams having the oscillating frequency of from 5 to 50 Hz and the energy density of from 100 to 500 mJ/cm$^2$ which scans with the overlapping ratio of from 80 to 98% to treat the whole surface of the substrate having the island-like semiconductor layers formed thereon. Note that there is no limitation on the conditions of the laser light irradiation, and the conditions may be appropriately decided.

Figure 9B:
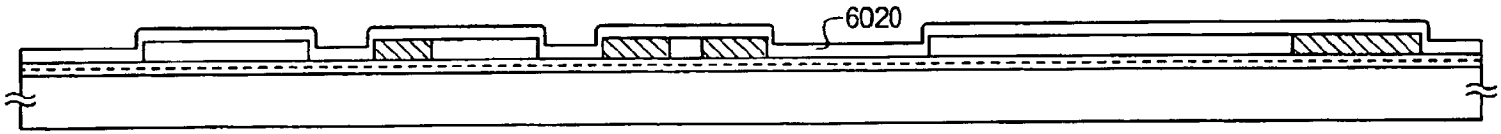

Then, a gate insulating film 6020 is formed from an insulating film containing silicon by plasma CVD or sputtering to a thickness of from 10 to 150 nm. For example, a silicon nitride oxide film with a thickness of 120 nm is formed. A single layer or lamination of other insulating films containing silicon may also be used as the gate insulating film (FIG. 9B).

Next, a first conductive layer to be gate electrodes is formed. Though the conductive layer may be a single-layer conductive layer, it may have a lamination structure of, for example, two or three layers, if necessary. In this embodiment, a lamination layer consisting of a conductive layer (A) 6021 made of a conductive metallic nitride film and a conductive layer (B) 6022 made of a metal film is formed. The conductive layer (B) 6022 may be formed of an element selected from a group consisting of tantalum (Ta), titanium (Ti), molybdenum (Mo), and tungsten (W), or an alloy containing the foregoing elements as its main constituent, or an alloy film of a combination of the elements (typically Mo—W alloy film or Mo—Ta alloy film). The conductive layer (A) 6021 may be formed of tantalum nitride (TaN), tungsten nitride (WN), titanium nitride (TiN) or molybdenum nitride (MoN). Further, the conductive layer (A) 6021 also may be formed of tungsten silicide, titanium silicide or molybdenum silicide as a substitute material. As to the conductive layer (B) 6022, it is preferable that the concentration of the impurity contained is reduced in order to lower the resistance. In particular, the concentration of oxygen is desirable to be 30 ppm or less. For example, if the concentration of oxygen is 30 ppm or less, resistance value of 20 $\mu\Omega$cm or less can be realized with respect to tungsten (W).

Figure 9C:
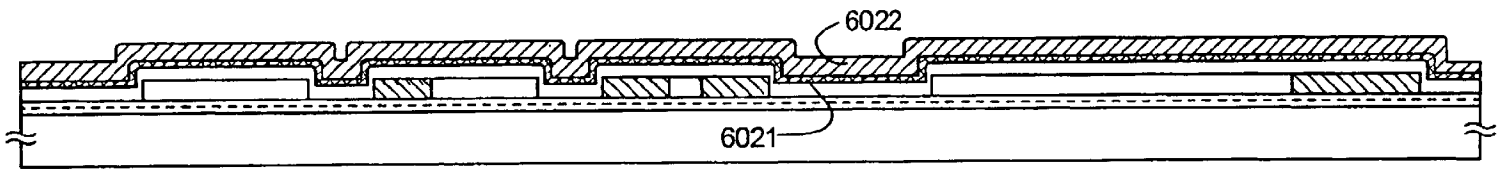

The thickness of the conductive layer (A) 6021 is 10 to 50 nm (preferably 20 to 30 nm) while the thickness of the conductive layer (B) 6022 is 200 to 400 nm (preferably 250 to 350 nm). In this embodiment, a tantalum nitride film with a thickness of 50 nm is used as the conductive layer (A) 6021 while a Ta film with a thickness of 350 nm is used as the conductive layer (B) 6022, both of which are formed by sputtering. When sputtering is used to form the films, by adding an appropriate amount of Xe or Kr to Ar as the sputtering gas, the internal stress of the film to be formed can be alleviated to prevent the film from peeling off. Note that, though not shown, it is effective to form a silicon film with a thickness of from 2 to 20 nm, doped with phosphorus (P), under the conductive layer (A) 6021. This improves the adherence of the conductive layer to be formed thereon, and oxidation can be prevented. At the same time, a small amount of alkaline element contained in the conductive layer (A) or the conductive layer (B) can be prevented from diffusing into the gate insulating film 6020 (FIG. 9C).

Figure 9D:
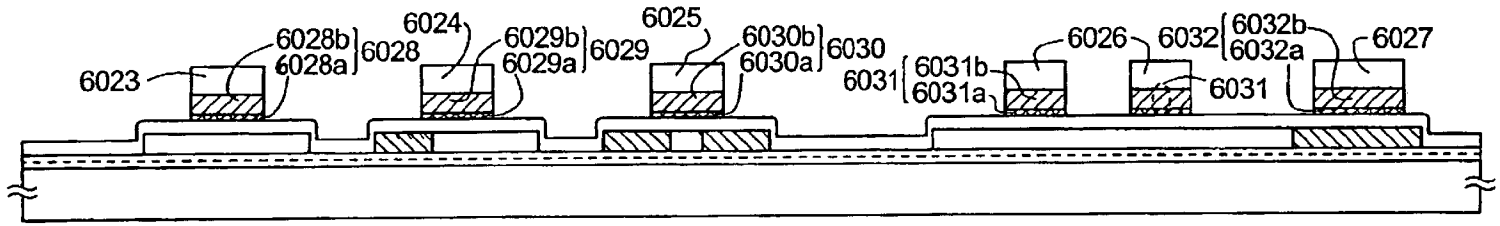

Then, resist masks 6023 to 6027 are formed and the conductive layers (A) 6021 and (B) 6022 are etched together to form gate electrodes 6028 to 6031, and a capacitor wiring 6032. The gate electrodes 6028 to 6031 and the a capacitor wiring 6032 are integrally formed from the conducive layer (A) including regions 6028*a* to 6032*a* and from the conductive layer (B) including regions 6028*b* to 6032*b*. Here, the gate electrodes 6029 and 6030 of TFTs constituting the driving circuit such as a driver are formed so as to partially overlap the impurity regions 6017 and 6018 through the gate insulating film 6020 (FIG. 9D).

Then, for the purpose of forming the source and drain regions of the p-channel TFT of the driving circuit, a step of doping an impurity element imparting p-type conductivity is carried out. Here, with the gate electrode 6028 being as the mask, the impurity region is formed in a self-aligning manner. At this point, the regions where the n-channel TFTs are to be formed are covered with a resist mask 6033.

Figure 10A:
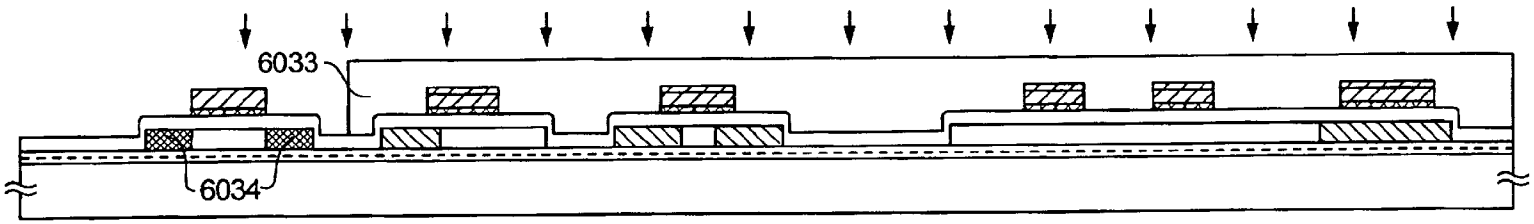
FIGS. 10A to 10D are views showing the fabricating process example of the liquid crystal display device of the present invention.

Impurity regions 6034 are formed by ion doping using diborane ($B_2H_6$). The concentration of boron (B) in these regions is $3\times10^{20}$ to $3\times10^{21}$ atoms/cm$^3$. Herein, the concentration of the impurity element imparting p-type conductivity contained in the impurity regions 6034 formed here is referred to as ($p^{++}$) (FIG. 10A).

Figure 10B:
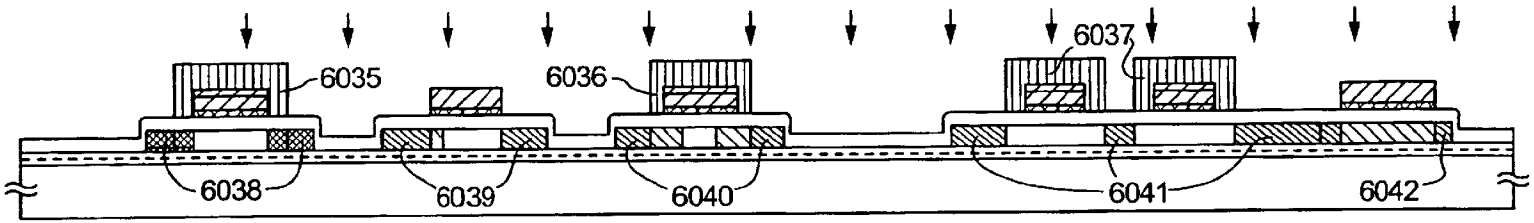

Next, in the n-channel TFTs, impurity regions to function as source regions or drain regions are formed. Resist masks 6035 to 6037 are formed and an impurity element imparting n-type conductivity is doped to form impurity regions 6038 to 6042. This is done by ion doping using phosphine ($PH_3$) with the concentration of phosphorus (P) in these regions being $1\times10^{20}$ to $1\times10^{21}$ atoms/cm$^3$. Herein, the concentration of the impurity element imparting n-type conductivity contained in the impurity regions 6038 to 6042 formed here is referred to as ($n^+$) (FIG. 10B).

The impurity regions 6038 to 6042 already contain phosphorus (P) or boron (B) doped in previous steps, but since phosphorus (P) is doped at a sufficiently greater concentration as compared to the concentration of previous impurities, the influence of phosphorus (P) or boron (B) doped in the previous steps can be neglected. Further, since the concentration of phosphorus (P) doped in the impurity regions 6038 is ½ to ⅓ of that of boron (B) doped in FIG. 10A, the conductivity of p-type is secured without exerting influence on the TFT characteristics.

Figure 10C:
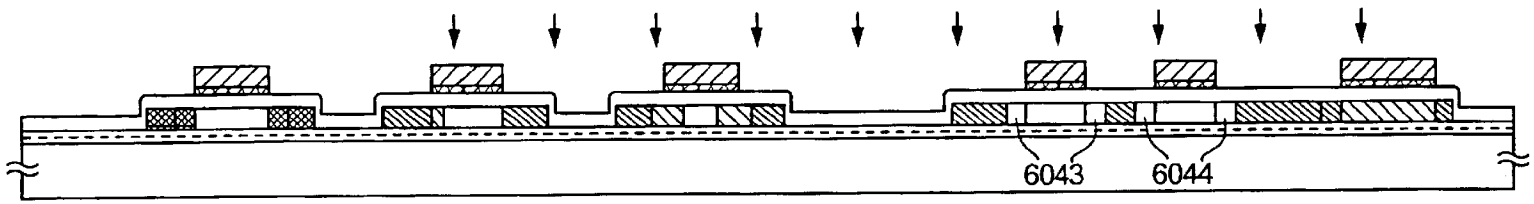

Then, for the purpose of forming the LDD regions of the n-channel TFT of the pixel portion, a step of doping impurity element imparting n-type conductivity is carried out. Here, an impurity element imparting n-type conductivity is doped in a self-aligning manner by ion doping with the gate electrode 6031 as a mask. The concentration of the doped phosphorus (P) is $1\times10^{6}$ to $5\times10^{18}$ atoms/cm$^3$. By carrying out the doping with the concentration lower than that of the impurity elements doped in FIGS. 9A, 10A, and 10B, only impurity regions 6043 and 6044 are formed actually. Herein, the concentration of the impurity element imparting n-type conductivity contained in the impurity regions 6043 and 6044 formed here is referred to as ($n^-$) (FIG. 10C).

Here, an SiON film or the like may be formed to a thickness of 200 nm as an interlayer film in order to prevent the Ta film of the gate electrode from peeling off.

After that, a heat treatment step is carried out to activate the impurity elements imparting n or p-type conductivity and doped at the respective concentrations. The step can be carried out by furnace annealing, laser annealing, or rapid thermal annealing (RTA). Here, the activation step is carried out by furnace annealing. Heat treatment is performed at the concentration of oxygen of 1 ppm or less, preferably 0.1 ppm or less, in a nitrogen atmosphere at 400 to 800° C., typically 500 to 600° C., 500° C., in this embodiment, for four hours. Further, in the case of using a quartz substrate or the like having heat resistance as the substrate 6001, a heat treatment may be carried out at 800° C. for 1 hour. Then, the activation of the impurity element can be realized, and an impurity region doped with the impurity element and a channel forming region are satisfactory joined together. Note that this effect may not be obtained in the case where an interlayer film for preventing the Ta film of the gate electrode from peeling off has been formed.

In the above heat treatment, conductive layers (C) 6028*c* to 6032*c* are formed to a thickness of 5 to 80 nm on the surface of metallic films 6028*b* to 6032*c* constituting the gate electrodes 6028 to 6031 and the capacitor wiring 6032. For example, tungsten nitride (WN) and tantalum nitride (TaN) can be formed when the conductive layers (B) 6028*b* to 6032*b* are tungsten (W) and tantalum (Ta), respectively. The conductive layers (C) 6028*c* to 6032*c* can be formed similarly by exposing the gate electrodes 6028 to 6031 and the capacitor wiring 6032 to a plasma atmosphere containing nitrogen using nitrogen or ammonia. Then, heat treatment is carried out in an atmosphere containing 3 to 100% of hydrogen at 300 to 450° C. for 1 to 12 hours to hydrogenate the island-like semiconductor layers. This is a step where the dangling bonds in the semiconductor layers are terminated by thermally excited hydrogen. As other means for hydrogenation, plasma hydrogenation (hydrogen excited by plasma is used) may be carried out.

Figure 10D:
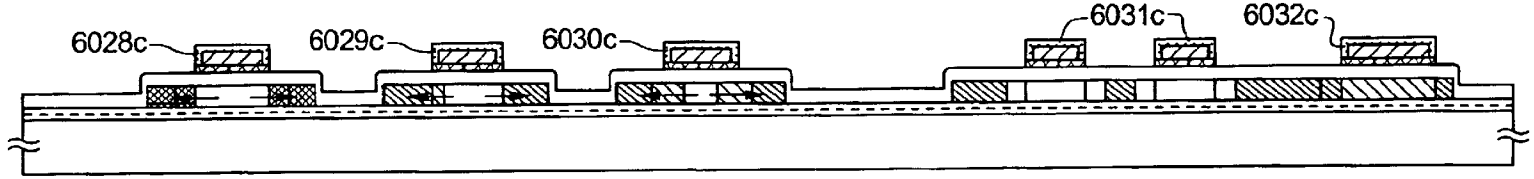

In the case where the island-like semiconductor layers are formed from an amorphous silicon film by the crystallization method using a catalytic element, a small amount of catalytic element remains in the island-like semiconductor layers. Of course, it is still possible to complete a TFT in such a condition, but it is more desirable to remove the remaining catalytic element, at least from the channel forming region. To utilize the gettering action by phosphorus (P) is one of the means for removing the catalytic element. The concentration of phosphorus (P) necessary for the gettering is about the same as that in the impurity region ($n^+$) formed in FIG. 10B. By the heat treatment in the activation step carried out here, the catalytic element can be gettered from the channel forming regions of the n-channel TFTs and the p-channel TFTs (FIG. 10D).

Figure 11A:
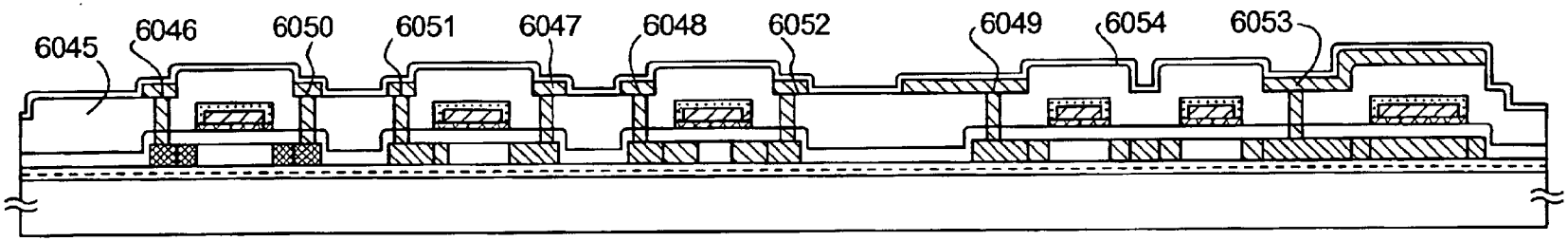
FIGS. 11A and 11B are views showing the fabricating process example of the liquid crystal display device of the present invention.

A first interlayer insulating film 6045 is formed from a silicon oxide film or a silicon nitride oxide film to a thickness of from 500 to 1500 nm. After that, contact holes reaching the source regions or the drain regions of the respective island-like semiconductor layers are formed, and source wirings 6046 to 6049 and drain wirings 6050 to 6053 are formed (FIG. 11A). Although not shown, in this embodiment, the electrode is a lamination film of three-layer structure obtained by forming a Ti film with a thickness of 100 nm, an aluminum film containing Ti and having a thickness of 500 nm, and another Ti film with a thickness of 150 nm, which are formed continuously by sputtering. Then, as a passivation film 6054, a silicon nitride film, a silicon oxide film, or a silicon nitride oxide film is formed to a thickness of from 50 to 500 nm (typically 100 to 300 nm). In this embodiment, the passivation film 6054 is a lamination film of a silicon nitride film with a thickness of 50 nm and a silicon oxide film with a thickness of 24.5 nm. Hydrogenation treatment carried out in this condition results in improvement in the TFT characteristics. For example, heat treatment in an atmosphere containing 3 to 100% of hydrogen at 300 to 450° C. for 1 to 12 hours is preferable. The use of plasma hydrogenation instead brings about similar effects. Note that, here, an opening portion may be formed in the passivation film 6054 at a position where a contact hole for connecting a pixel electrode and the drain wirings is to be formed later (FIG. 11A).

Figure 11B:
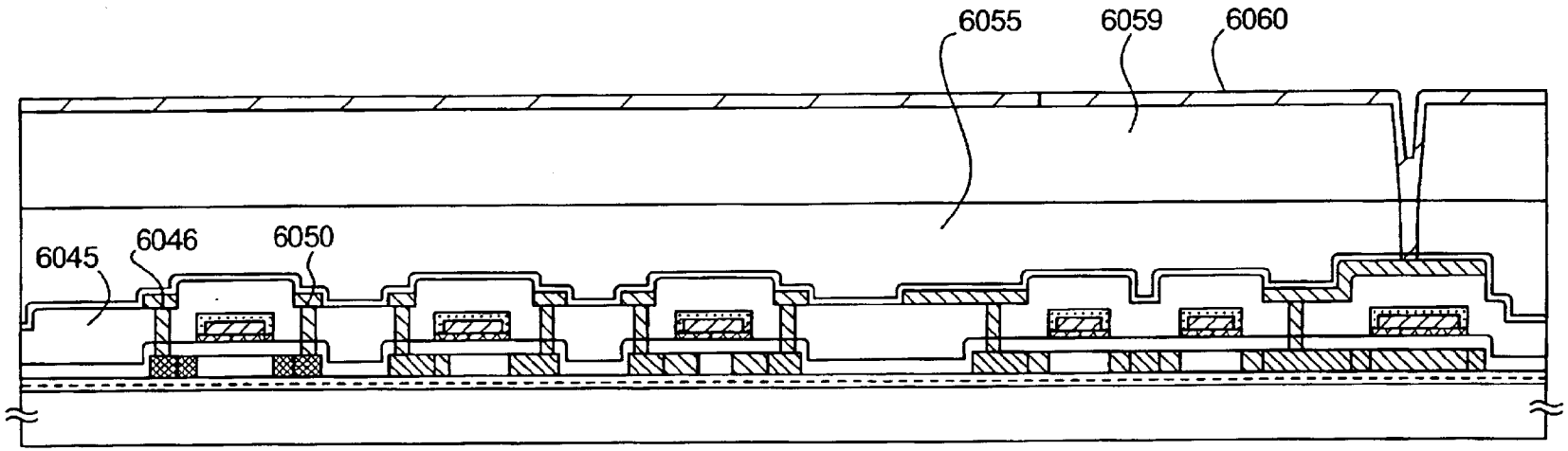

After that, a second interlayer insulating film 6055 of an organic resin is formed to a thickness of from 1.0 to 1.5 $\mu$m. As the organic resin, polyimide, acrylic resin, polyamide, polyimideamide, BCB (benzocyclobutene), or the like can be used. Here, acrylic resin of the type that is thermally polymerized type after being applied to the substrate is used, and the film is formed by carrying out baking at 250° C. (FIG. 11B).

In this embodiment, a black matrix is formed to have a laminate structure in which a Ti film is formed to a thickness of 100 nm, and then, an alloy film of Al and Ti is formed to a thickness of 300 nm.

After that, a third interlayer insulating film 6059 of an organic resin is formed to a thickness of from 1.0 to 1.5 $\mu$m m. As the organic resin, the same resin that forms the second interlayer insulating film can be used. Here, polyimide of the type that is thermally polymerized after being applied to the substrate is used, and the film is formed by carrying out baking at 300° C.

A contact hole reaching the drain wirings 6053 is formed through the second interlayer insulating film 6055 and the third interlayer insulating film 6059, and a pixel electrode 6060 is formed. In a transmission type liquid crystal display device according to the present invention, a transparent conductive film such as an indium tin oxide (ITO) film is used for the pixel electrode 6060 (FIG. 11B).

Figure 12:
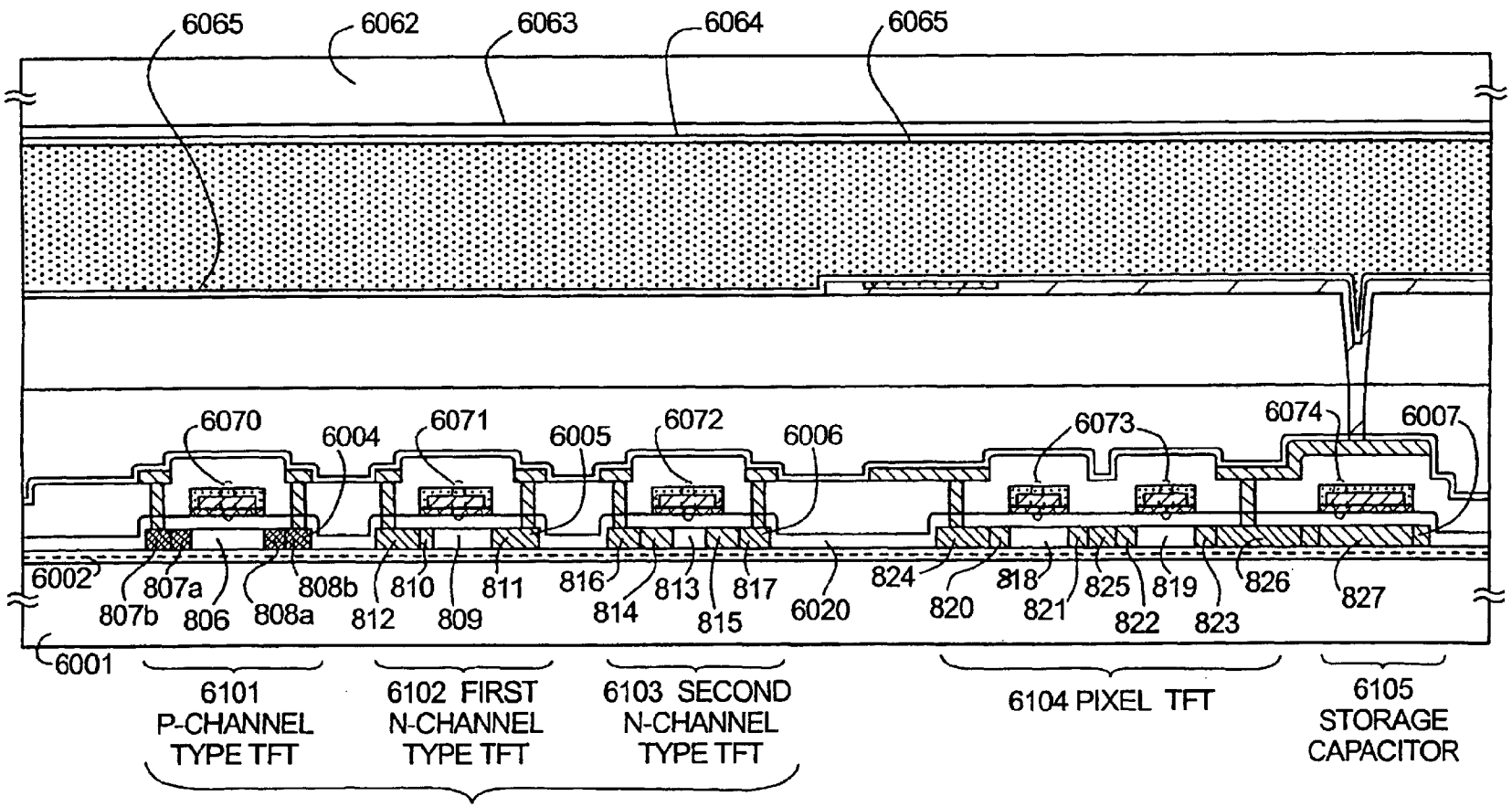
FIG. 12 is a view showing the fabricating process example of the liquid crystal display device of the present invention.

In this way, a substrate having a driving circuit TFT and a pixel TFT in the pixel portion on the same substrate is completed. In the driving circuit, a p-channel TFT 6101, a first n-channel TFT 6102, and a second n-channel TFT 6103 are formed. In the pixel portion, a pixel TFT 6104 and a storage capacitor 6105 are formed (FIG. 12). Such a substrate is herein referred to as an active matrix substrate for convenience.

Described next is a process of manufacturing a transmission type liquid crystal display device on the basis of the active matrix substrate manufactured through the above steps.

An orientation film 6061 is formed on the active matrix substrate in the state of FIG. 12. In this embodiment, a polyimide is used for the orientation film 6061. Next, an opposing substrate is prepared. The opposing substrate is formed of a glass substrate 6062, an opposing electrode 6063 made from a transparent conductive film, and an orientation film 6064.

In this embodiment, a polyimide resin in which liquid crystal molecules are orientated parallel to the substrate is used for the orientation film. Note that, after forming the orientation films, a rubbing treatment is performed to give the liquid crystal molecules a certain fixed pre-tilt angle, bringing them into parallel orientation.

The active matrix substrate and the opposing substrate which have undergone the above steps are then joined to each other by a known cell assembling process through a sealing material or a spacer (neither is shown). After that, a liquid crystal 6065 is injected between the substrates and an end sealing material (not shown) is used to completely seal the substrates. A transmission type liquid crystal display device as shown in FIG. 12 is thus completed.

In this embodiment, the transmission type liquid crystal display device is designed so as to operate in a TN (Twisted Nematic) mode. Accordingly, a polarizing plate (not shown) is disposed on an upper part of the transmission type liquid crystal display device.

The p-channel TFT 6101 of the driving circuit has a channel forming region 806, source regions 807*a* and 807*b*, and drain regions 808*a* and 808*b* in the island-like semiconductor layer 6004. The first n-channel TFT 6102 has a channel forming region 809, an LDD region 810 that overlaps the gate electrode 6071 (hereafter referred to as $L_{ov}$ for such LDD regions), a source region 811, and a drain region 812 in the island-like semiconductor layer 6005. The length of the $L_{ov}$ region in the direction of the channel length is 0.5 to 3.0 $\mu$m, preferably 1.0 to 1.5 $\mu$m. The second n-channel TFT 6103 has a channel forming region 813, LDD regions 814 and 815, a source region 816, and a drain region 817 in the island-like semiconductor layer 6006. The LDD regions can be divided into the $L_{ov}$, region and an LDD region which does not overlap with the gate electrode 6072 (hereafter referred to as a $L_{off}$ region). The length of the $L_{off}$ region in the direction of the channel length is 0.3 to 2.0 $\mu$m, preferably 0.5 to 1.5 $\mu$m. The pixel TFT 6104 has channel forming regions 818 and 819, $L_{off}$ regions 820 to 823, and source or drain regions 824 to 826 in the island shape semiconductor layer 6007. The length of the $L_{off}$ regions in the direction of the channel length is 0.5 to 3.0 $\mu$m, preferably 1.5 to 2.5 $\mu$m. An offset region (not shown) is formed between the channel forming regions 818 and 819 of the pixel TFT 6104 and the $L_{off}$ regions 820 to 823 that are (LDD regions of the pixel TFT). Further, a storage capacitor 805 is formed of the capacitor wirings 6074, an insulating film formed of the gate insulating film 6020, and a semiconductor layer 827 with an impurity element imparting n-type conductivity doped therein for connecting with the drain region 826 of the pixel TFT 6073. In FIG. 12, the pixel TFT 804 has the double gate structure, but it may have the single gate structure, or the multi gate structure provided with a plurality of gate electrodes.

As described above, by selecting the optimal structure of TFTs that constitute in the respective circuits in accordance with specifications for the pixel TFT and the driver, the operating performance and the reliability of the liquid crystal display device can be improved in this embodiment.

Note that the description has been made on the transmission type liquid crystal display device. However, the present invention is not limited to thereto, and it may also be applied to a reflection type liquid crystal display device.

Embodiment 2

Shown in this embodiment is an example in which a liquid crystal display device according to the present invention is composed of a reverse stagger type TFT.

Reference is made to FIGS. 13A and 13B which are sectional views showing reverse stagger type n-channel TFTs for forming the liquid crystal display device of this embodiment. Needless to say, both p-channel TFT and n-channel TFT may be used to form a CMOS circuit, although merely one n-channel TFT is shown in each of FIGS. 13A and 13B. Also it goes without saying that a pixel TFT may be formed with a similar structure.

Referring to FIG. 13A, denoted by 4001 is a substrate, a material of which is chosen from ones mentioned in Embodiment 1. Reference symbol 4002 denotes a silicon oxide film, 4003, a gate electrode, and 4004, a gate insulating film. Denoted by 4005, 4006, 4007, 4008 are active layers made of a polycrystalline silicon film. To form these active layers, the same method by which an amorphous silicon film is crystallized into a polycrystalline silicon film, described in Embodiment 1, is used. Alternatively, the amorphous silicon film may be crystallized by laser light (preferably, linear laser light or sheet-like laser light). Specifically, denoted by 4005 is a source region, 4006, a drain region, 4007, low concentration impurity regions (LDD regions), and 4008, a channel forming region. Reference symbol 4009 denotes a channel protective film, 4010, an interlayer insulating film, 4011, a source electrode, and 4012, a drain electrode.

Referring next to FIG. 13B, a description will be given on a case where the liquid crystal display device is composed of a reverse stagger type TFT having a structure different from that of the TFT shown in FIG. 13A.

Also in FIG. 13B, merely one n-channel TFT is shown in the drawing. However, as described above, a CMOS circuit may of course be composed of both the p-channel TFT and the n-channel TFT. Also it goes without saying that a pixel TFT may be formed with a similar structure.

Reference symbol 4101 denotes a substrate, 4102, a silicon oxide film, and 4103, a gate electrode. Denoted by

4104 is a benzocyclobutene (BCB) film, of which top surface is planarized. A silicon nitride film is denoted by 4105. The BCB film and the silicon nitride film together form a gate insulating film. Reference symbols 4106, 4107, 4108, 4109 denote active layers made of a polycrystalline silicon film. To form these active layers, the same method by which an amorphous silicon film is crystallized into a polycrystalline silicon film, described in Embodiment 1, is used. Alternatively, the amorphous silicon film may be crystallized by laser light (preferably, linear laser light or sheet-like laser light). Specifically, denoted by 4106 is a source region, 4107, a drain region, 4108, low concentration impurity regions (LDD regions), and 4109, a channel forming region. Reference symbol 4110 denotes a channel protective film, 4111, an interlayer insulating film, 4112, a source electrode, and 4113, a drain electrode.

According to this embodiment, the gate insulating film consisting of the BCB film and the silicon nitride film are leveled so that the amorphous silicon film to be formed thereon is also planar. Therefore in crystallizing the amorphous silicon film into a polycrystalline silicon film, more uniform polycrystalline silicon film can be obtained as compared to conventional reverse stagger type TFTs.

Embodiment 3

In the above-described liquid crystal display devices of the present invention, various kinds of liquid crystal may be used other than the nematic liquid crystal. For example, usable liquid crystal materials include ones disclosed in: 1998, SID, "Characteristics and Driving Scheme of Polymer-Stabilized Monostable FLCD Exhibiting Fast Response Time and High Contrast Ratio with Gray-Scale Capability" by H. Furue et al.; 1997, SID DIGEST, 841, "A Full-Color Thresholdless Antiferroelectric LCD Exhibiting Wide Viewing Angle with Fast Response Time" by T. Yoshida et al.; 1996, J. Mater. Chem. 6(4), 671–673, "Thresholdless Antiferroelectricity in Liquid Crystals and its Application to Displays" by S. Inui et al.; and U.S. Pat. No. 5,594,569.

Figure 14:
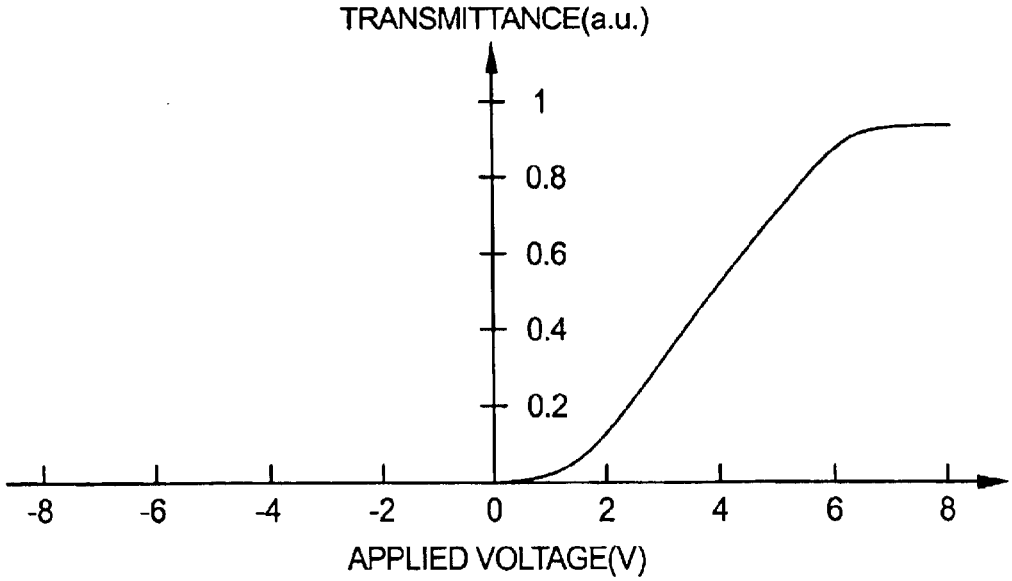
FIG. 14 is a graph showing applied voltage—transmissivity characteristics of ferroelectric liquid crystal that exhibits Half-V-shaped electro-optical characteristics.

FIG. 14 shows electro-optical characteristics of single stable ferroelectric liquid crystal (FLC) in which the ferroelectric liquid crystal (FLC) exhibiting a transition series of isometric phase-cholesteric phase-chiral smectic C phase is used, transition of cholesteric phase-chiral smectic C phase is caused while applying a DC voltage, and a cone edge is made to almost coincide with a rubbing direction. A display mode by the ferroelectric liquid crystal as shown in FIG. 14 is called a "Half-V-shaped switching mode". The vertical axis of the graph shown in FIG. 14 indicates transmittance (in an arbitrary unit) and the horizontal axis indicates applied voltage. The details of the "Half-V-shaped switching mode" are described in "Half—V-shaped switching mode FLCD" by Terada et al., Collection of Preliminary Paper for 46th Applied Physics Concerned Joint Lecture Meeting, March 1993, p. 1316, and "Time-division full-color LCD with ferroelectric liquid crystal" by Yoshihara et al., Liquid Crystal, Vol. 3, No. 3, p. 190.

As shown in FIG. 14, it is understood that when such ferroelectric mixed liquid crystal is used, low voltage driving and gray-scale display become possible. For the liquid crystal display device of the present invention, it is also possible to use the ferroelectric liquid crystal exhibiting such electro-optical characteristics.

In addition, a liquid crystal that exhibits an antiferroelectric phase in a certain temperature range is called an antiferroelectric liquid crystal (AFLC). There are mixed liquid crystals mixed therein, with an anti-ferroelectric liquid crystal, that show electro-optical response characteristics in which the transmittance continuously changes in response to the electric field, and are called thresholdless antiferroelectric mixed liquid crystals. There are thresholdless antiferroelectric mixed liquid crystals that show V-shaped electro-optical response characteristics, and some have been found to have a drive voltage of approximately ±2.5 V (when the cell thickness is between 1 $\mu$m and 2 $\mu$m).

Further, in general the spontaneous polarization of a thresholdless antiferroelectric mixed liquid crystal is large, and the dielectric constant of the liquid crystal itself is high. Thus a relatively large storage capacitor for the pixel is necessary when a thresholdless antiferroelectric mixed liquid crystal is used for a liquid crystal display device. Therefore it is desirable to use a thresholdless antiferroelectric mixed liquid crystal that has a small spontaneous polarization.

Note that by using this type of thresholdless antiferroelectric mixed liquid crystal in the liquid crystal display device of the present invention, a low voltage drive can be realized, so that low power consumption can also be realized.

Embodiment 4

The present invention may be embodied in all the electronic equipments that incorporate those display devices into display units.

As such electronic equipment, a video camera, a digital camera, a projector (rear-type or front-type projector), a head mount display (goggle-type display), a game machine, a navigation system for vehicles, a personal computer, and a portable information terminal (a mobile computer, a cellular phone, an electronic book, etc.) may be enumerated. Examples of those are shown in FIGS. 15A and 15B, and FIGS. 16A and 16F.

Figure 15A:
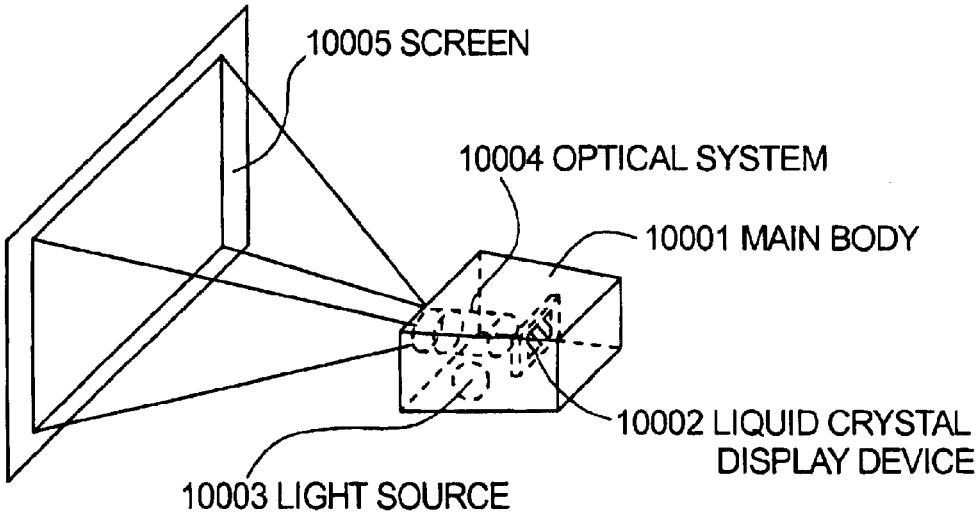
FIGS. 15A and 15B are diagrams showing examples of electronic equipment having incorporated therein a liquid crystal display device of the present invention.

FIG. 15A shows a front type projector which is constituted of a main body 10001, a liquid crystal display device 10002 of the present invention, a light source 10003, an optical system 10004, and a screen 10005. Although FIG. 15A shows a front projector including one liquid crystal display device, when three liquid crystal display devices (made to correspond to light of R, G and B, respectively) are incorporated, a front type projector with higher resolution and higher difinition can be realized.

Figure 15B:
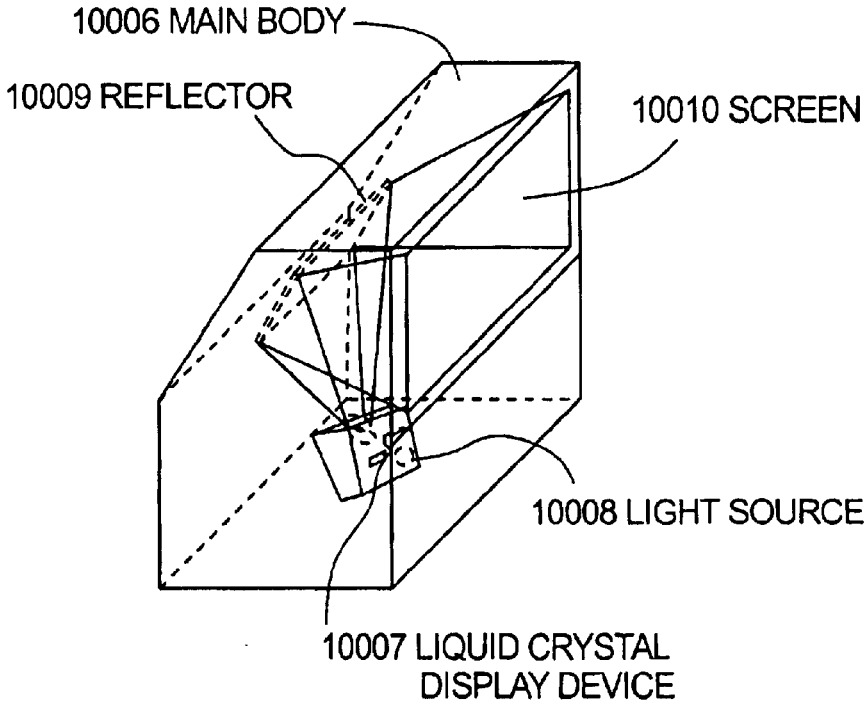

FIG. 15B shows a rear type projector which is constituted of a main body 10006, a liquid crystal display device 10007 of the present invention, a light source 10008, a reflector 10009, and a screen 10010. FIG. 15B shows a rear type projector including three liquid crystal display devices (made to correspond to light of R, G and B, respectively). It is also possible to provide a rear type projector including one liquid crystal display device of the present invention.

Figure 16A:
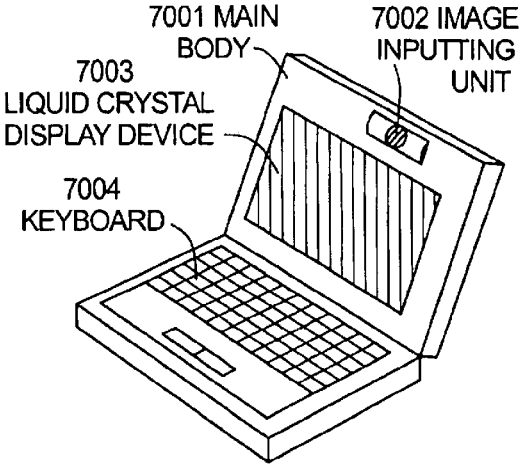
FIGS. 16A to 16F are diagrams showing examples of electronic equipment having incorporated therein one or more liquid crystal display devices of the present invention.

FIG. 16A shows a personal computer comprising a main body 7001, an image inputting unit 7002, a liquid crystal display display device 7003 of the present invention, and a key board 7004 of the present invention.

Figure 16B:
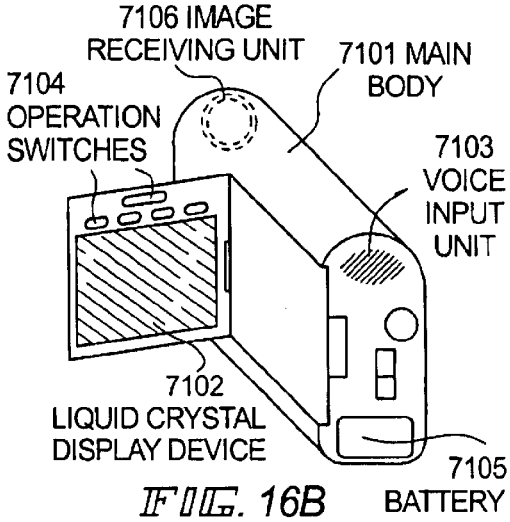

FIG. 16B shows a video camera comprising a main body 7101, a liquid crystal display device 7102, a voice input unit 7103, operation switches 7104, a battery 7105, and an image receiving unit 7106 of the present invention.

Figure 16D:
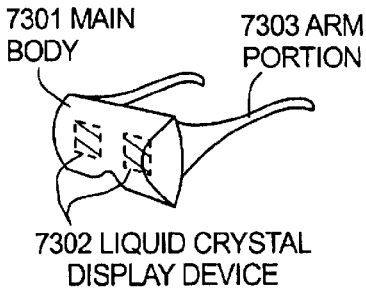
Figure 16C:
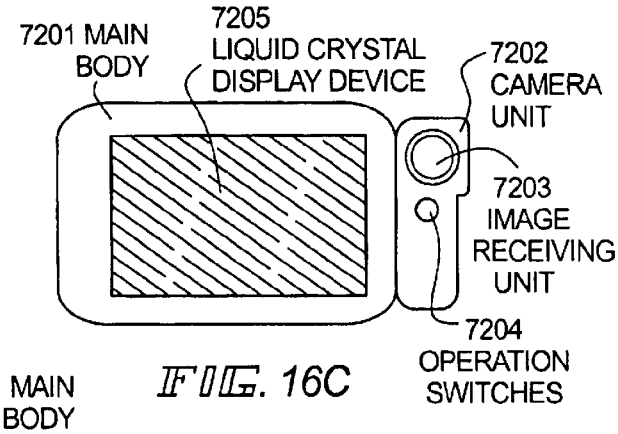

FIG. 16C shows a mobile computer comprising a main body 7201, a camera unit 7202, an image receiving unit 7203, an operation switch 7204, and a liquid crystal display device 7205 of the present invention.

FIG. 16D shows a goggle-type display comprising a main body 7301, a liquid crystal display device 7302 and arm portions 7303 of the present invention.

Figure 16E:
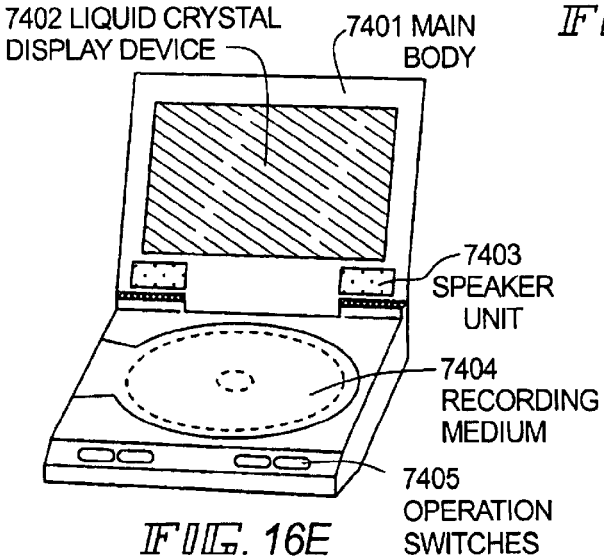

FIG. 16E shows a player that employs a recoding medium in which programs are recorded (hereinafter referred to as recording medium), and comprises a main body 7401, a liquid crystal display display device 7402, a speaker unit 7403, a recording medium 404, and an operation switch 7405 of the present invention. Note that this player uses as the recoding medium a DVD (digital versatile disc), a CD of the present invention to serve as a tool for enjoying music or movies, for playing video games and for connecting to the Internet.

Figure 16F:
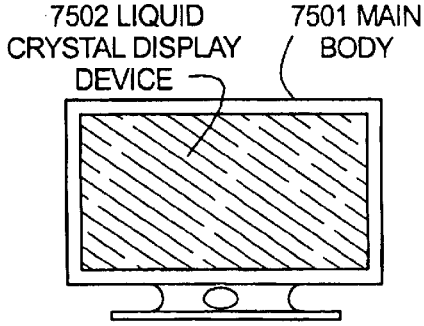
Figure 17:
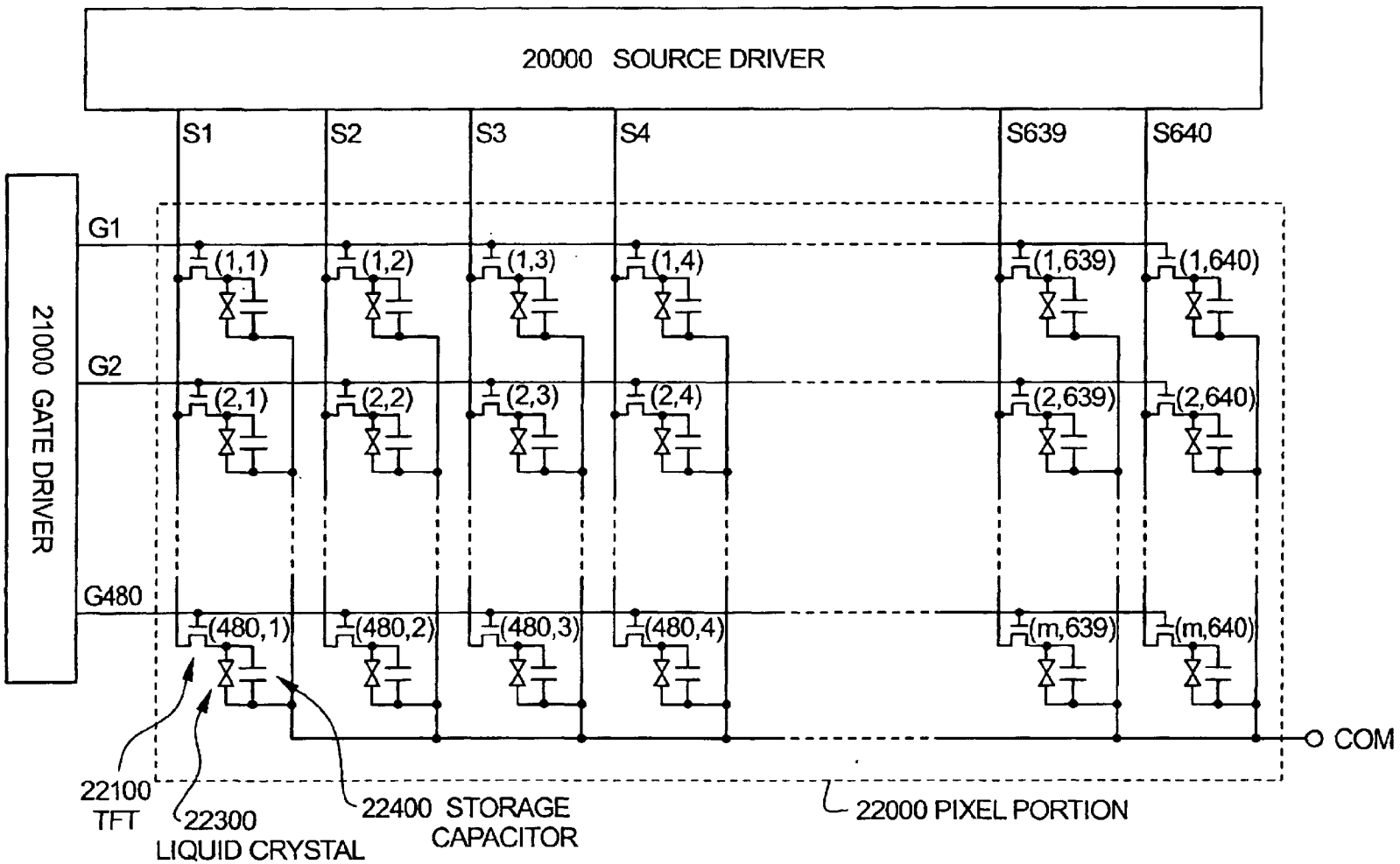
FIG. 17 is a schematic structural view of a conventional liquid crystal display device.
Figure 18:
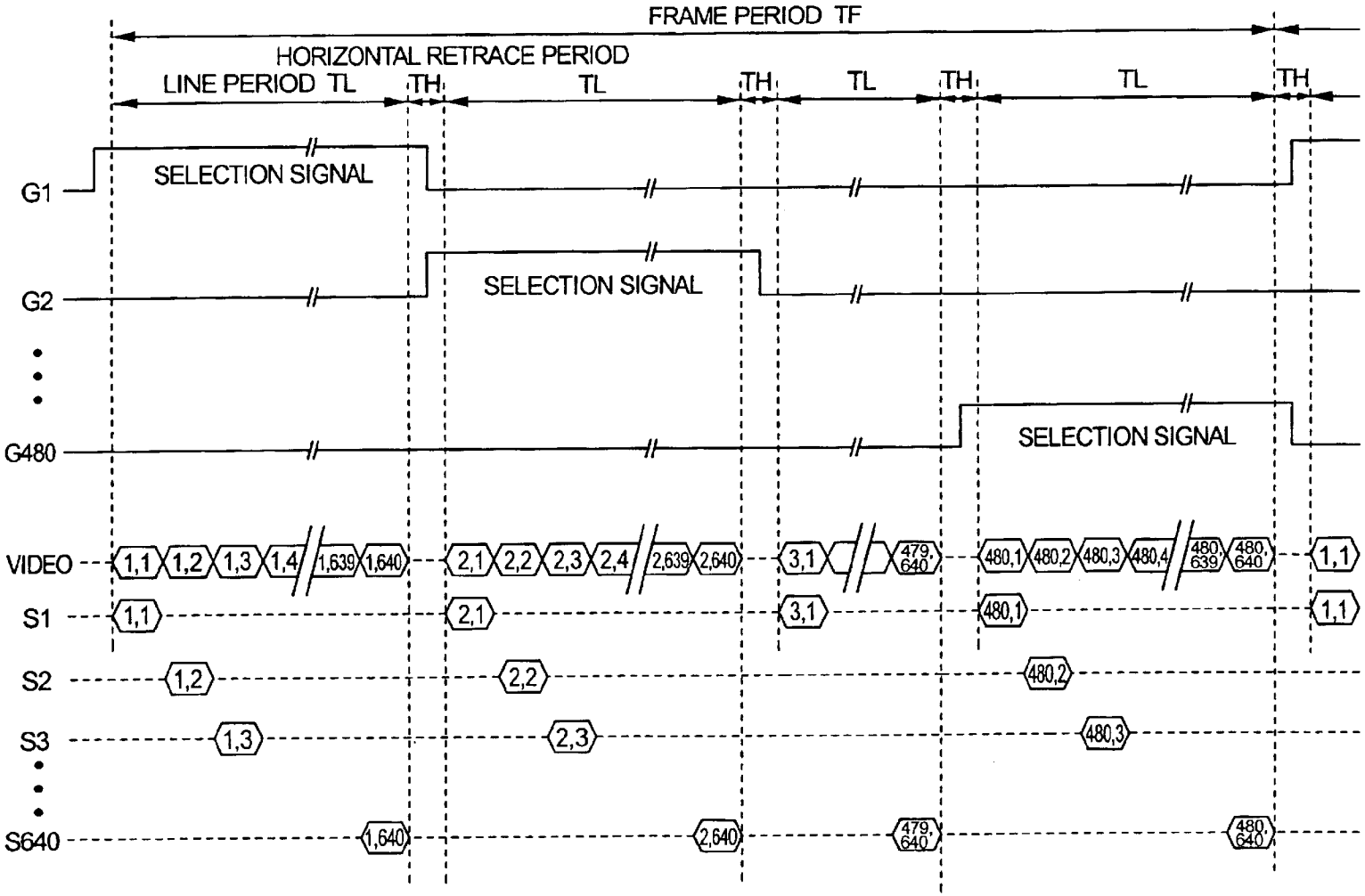
FIG. 18 is a driving timing chart of the conventional liquid crystal display device.
Figure 19:
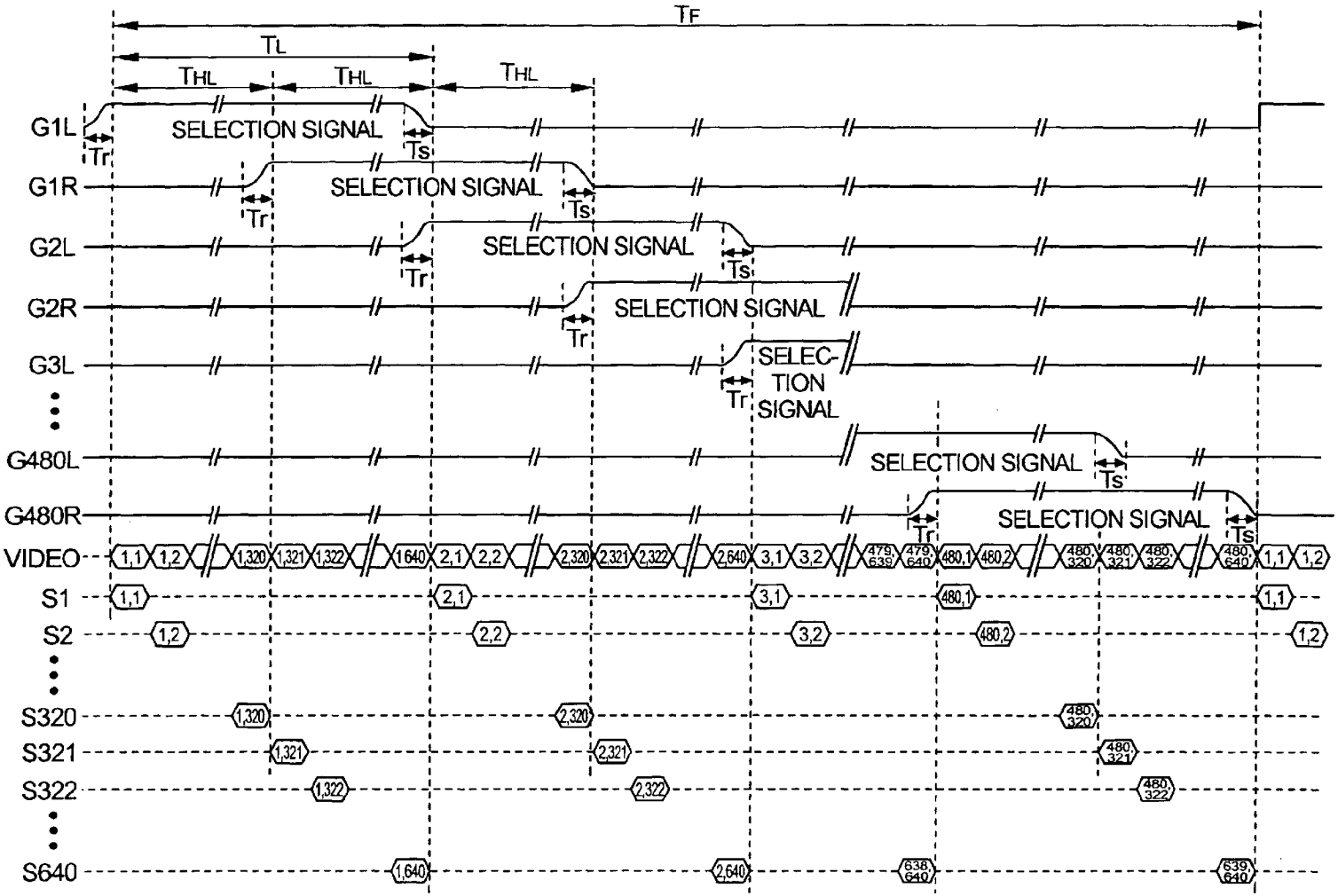
FIG. 19 is a driving timing chart of a liquid crystal display device of the present invention.

FIG. 16F shows a display device using a liquid crystal display device of the present invention. Reference numeral 7501 designates a main body and 7502, the liquid crystal display device of the present invention.

As described above, the present invention has so wide application range that it is applicable to electronic equipments in any field.

As described above, in the liquid crystal display device of the present invention, since the selection signal is kept inputted to the gate signal line after the video signal is inputted to the source signal line, even in the case where the load capacitor of the gate signal line and the source signal line is large, it is possible to gain a time sufficient to write the video signal into the liquid crystal and the storage capacitor. Besides, even if the operation speed of the TFT of the pixel is slow, it is possible to gain a time sufficient to write the video signal into the liquid crystal and the storage capacitor.

Although a liquid crystal display devices have been described in the preferred embodiments, the present invention can be applied to other types of display devices such as an active matrix type electro-luminescence display device.

What is claimed is:

1. A display device comprising:

a pixel portion in which (m×2n) pixels are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GrL . . . , GmL (1≦r≦m); and a second gate driver for supplying selection signals to m second gate signal lines G1R, G2R, . . . , GrR, . . . , GmR (1≦r≦m), wherein:

the pixels connected to the source signal lines S1, S2, . . . , Sn are supplied with the selection signals from the first gate signal lines G1L, G2L, . . . , GrR, . . . , GmL;

the pixels connected to the source signal lines Sn+1, SN+2, . . . , S2*n* are supplied with the selection signals from the second gate signal lines G1R, G2R, . . . , GrR, . . . , GmR;

the selection signal starts to be supplied to the second gate signal line GrR while the selection signal is supplied to the first gate signal line GrL; and the selection signal starts to be supplied to the first gate signal line Gr+1L while the selection signal is supplied to the second gate signal line GrR, wherein each of the pixel portion, the source driver, the first gate driver and the second gate driver comprises at least TFT formed over a same substrate, wherein the selection signal to the first gate signal line Gr+1L rises to a static state after the selection signal to the first signal line GrL falls, and wherein the selection signal to the first gate signal line Gr+1R rises to the static state after the selection signal to the first signal line GrR falls.

2. A display device comprising:

a pixel portion in which (m×2n) pixels are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GrL, . . . , GmL (1≦r≦m); and a second gate driver for supplying selection signals to m second gate signal lines G1R, G2R, . . . , GrR, . . . , GmR (1≦r≦m), wherein:

the pixels connected to the source signal lines S1, S2, . . . ,Sn are supplied with the selection signals from the first gate signal lines G1L, G2L, . . . , GrL, . . . , GmL;

the pixels connected to the source signal lines Sn+1, Sn+2, . . . , S2*n* are supplied with the selection signals from the second gate signal lines G1R, G2R, . . . , GrR, . . . , GmR; and the selection signals are sequentially supplied to the first gate signal line G1L, the second gate signal line G1R, the first gate signal line G2L, the second gate signal line G2R, . . . , the first gate signal line GmL, and the second gate signal line GmR in this order with a delay of a half period between the respective adjacent gate signal lines, wherein each of the pixel portion, the source driver, the first gate driver and the second gate driver comprises at least one TFT formed over a same substrate wherein the selection signal to the first gate signal line Gr+1L rises to a static state after the selection signal to the first signal line GrL falls, and wherein the selection signal to the first gate signal line Gr+1R rises to the static state after the selection signal to the first signal line GrR falls.

3. A rear projector comprising three display devices according to claim 1.

4. A rear projector comprising three display devices according to claim 2.

5. A front projector comprising three display devices according to claim 2.

6. A rear projector comprising one display device according to claim 2.

7. A front projector comprising one display device according to claim 2.

8. A head mount display comprising a display device according to claim 2.

9. A Computer comprising a display device according to claim 2.

10. A video camera comprising a display device according to claim 2.

11. A DVD player comprising a display device according to claim 2.

12. A display device comprising a display device according to claim 2.

13. A display device according to claim 2 is a liquid crystal display device.

14. A front projector comprising three display devices according to claim 1.

15. A rear projector comprising one display device according to claim 1.

16. A front projector comprising one display device according to claim 1.

17. A head mount display comprising a display device according to claim 1.

18. A computer comprising a display device according to claim 1.

19. A video camera comprising a display device according to claim 1.

20. A DVD player comprising a display device according to claim 1.

21. A display device comprising a display device according to claim 1.

22. A display device according to claim 1 is a liquid crystal display device.

23. A method of driving an active matrix display device comprising:

a pixel portion in which (m×2n) pixels are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GrL, . . . , GmL (1≦r≦m); and a second gate driver for supplying selection signals to m second gate signal lines G1R, G2R, . . . , GrR, . . . , GmR (1≦r≦m), wherein said method comprises the steps of:

supplying the pixels connected to the source signal lines S1, S2, . . . , Sn with the selection signals from the first gate signal lines G1L, G2L, . . . , GrL, . . . GmL;

supplying the pixels connected to the source signal lines Sn+1, Sn+2, . . . , S2*n* with the selection signals from the second gate signal lines G1R, G2R, . . . , GmR;

starting to supply the selection signal to the second gate signal line GrR while the selection signal is supplied to the first gate signal line GrL; and starting to supply the selection signal to the first gate signal line Gr+1 while the section signal is supplied to the second gate signal line GrR, wherein each of the pixel portion, the source driver, the first gate driver and the second gate driver comprises at least one TFT formed over a same substrate wherein the selection signal to the first gate signal line Gr+1L rises to a static state after the selection signal to the first signal line GrL falls, and wherein the selection signal to the first gate signal line Gr+1R rises to the static state after the selection signal to the first signal line GrR falls.

24. A method of driving an active matrix display device comprising:

a pixel portion in which (m×2n) pixels are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GrL, . . . , GmL (1≦r≦m); and a second gate driver for supplying selection signals to m second gate signal lines G1R, G2R, . . . , GrR, . . . , GmR (1≦r≦m), wherein said method comprises the steps of:

supplying the pixels connected to the source signal lines S1, S2, . . . , Sn with the selection signals from the first gate lines G1L, G2L, . . . , GrL, . . . , GmL;

supplying the pixels connected to the source signal lines Sn+1, Sn+2, . . . , S2*n* with the selection signals from the second gate lines G1R, G2R, . . . , GrR, . . . GmR; and sequentially supplying the selection signals to the first gate signal line G1L, the second gate signal line G1R, the first gate signal line G2L, the second gate signal line G2R, . . . , the first gate signal line GmL, and the second gate signal line GmR in this order with a delay of a half period between the respective adjacent gate signal lines, wherein each of the pixel portion, the source driver, the first gate driver and the second gate driver comprises at least one TFT formed over a same substrate wherein the selection signal to the first gate signal line Gr+1L rises to a static state after the selection signal to the first signal line GrL falls, and wherein the selection signal to the first gate signal line Gr+1R rises to the static state after the selection signal to the first signal line GrR falls.

25. A display device comprising:

a pixel portion in which (m×2n) pixels are arranged in matrix form (both m and n are natural numbers);

a source driver for supplying video signals to 2n source signal lines S1, S2, . . . , Sn, Sn+1, Sn+2, . . . , S2*n;* a first gate driver for supplying selection signals to m first gate signal lines G1L, G2L, . . . , GrL, . . . , GmL (1≦r≦m); and a second gate driver for supplying selection signals to m second gate signal lines G1R, G2R, . . . , GrR, . . . GmR (1≦r≦m) wherein:

the pixels connected to the source signal lines S1, S2, . . . , Sn are supplied with the selection signals from the first gate signal lines G1L, G2L, . . . , GrL, . . . , GmL;

the pixels connected to the source signal lines Sn+1, SN+2, . . . , S2*n* are supplied with the selection signals from the second gate signal lines G1R, G2R . . . , GrL, . . . GmR;

the selection signal starts to be supplied to the second gate signal line GrR while the selection signal is supplied to the first gate signal line GrL; and the selection signal starts to be supplied to the first gate signal line Gr+1L while the selection signal is supplied to the second gate signal line GrR, wherein the r first gate signal lines G1L, G2L, . . . , GrL, . . . , GmL of the first gate driver are not connected to the r second gate signal lines G1R, G2R, . . . , GrR, . . . , GmR of the second gate driver, wherein each of the pixel portion, the source driver, the first gate driver and the second gate driver comprises at least one TFT formed over a same substrate wherein the selection signal to the first gate signal line Gr+1L rises to a static state after the selection signal to the first signal line GrL falls, and wherein the selection signal to the first gate signal line Gr+1R rises to the static to the first signal line GrR falls.

* * * * *